United States Patent [19]

Hata et al.

[11] Patent Number: 4,561,401

[45] Date of Patent: Dec. 31, 1985

[54] AIR-FUEL RATIO CONTROL SYSTEM

[75] Inventors: Yoshitaka Hata, Fujisawa; Tatsuo Morita, Yokohama, both of Japan

[73] Assignee: Nissan Motor Company, Limited, Yokohama, Japan

[21] Appl. No.: 550,307

[22] Filed: Nov. 10, 1983

[30] Foreign Application Priority Data

Nov. 15, 1982 [JP] Japan ..... 57-199053

[51] Int. Cl.[4] ..... F02D 37/02; F02P 5/04

[52] U.S. Cl. ..... 123/486; 123/425; 123/435

[58] Field of Search ..... 123/486, 435, 425

[56] References Cited

U.S. PATENT DOCUMENTS

| | | | |
|---|---|---|---|
| 3,957,023 | 5/1976 | Peterson . | |
| 4,153,019 | 5/1979 | Laubenstein et al. | 123/425 |
| 4,314,534 | 2/1982 | Nakajima et al. . | |
| 4,344,400 | 8/1982 | Asano | 123/435 |
| 4,346,443 | 8/1982 | De Angelis et al. | 123/486 |
| 4,347,571 | 8/1982 | Leung et al. | 123/435 |
| 4,356,551 | 10/1982 | Iwase et al. | 123/435 |
| 4,359,992 | 11/1982 | Asano et al. | 123/486 |
| 4,376,429 | 3/1983 | Youngblood | 123/435 |
| 4,391,248 | 7/1983 | Latsch | 123/435 |
| 4,393,836 | 7/1983 | De Angelis et al. | 123/486 |
| 4,417,556 | 11/1983 | Latsch | 123/435 |
| 4,450,810 | 5/1984 | Wada et al. | 123/435 |
| 4,478,190 | 10/1984 | Kawa | 123/486 |
| 4,519,366 | 5/1985 | May . | |

FOREIGN PATENT DOCUMENTS

| | | |
|---|---|---|
| 2417187 | 10/1975 | Fed. Rep. of Germany . |
| 3210610 | 10/1983 | Fed. Rep. of Germany . |
| 2466623 | 4/1981 | France . |
| 1512213 | 5/1978 | United Kingdom . |
| 2060062 | 4/1981 | United Kingdom . |
| 1602256 | 11/1981 | United Kingdom . |
| 2091000 | 7/1982 | United Kingdom . |

OTHER PUBLICATIONS

British Search Report.

*Primary Examiner*—Raymond A. Nelli

*Attorney, Agent, or Firm*—Schwartz, Jeffery, Schwaab, Mack, Blumenthal & Evans

[57] ABSTRACT

A method and apparatus for the control of the air-fuel ratio of a mixture to an internal combustion engine. A value of fuel-delivery requirement for the engine is determined based upon engine load. An engine crankshaft position at which the pressure in each cylinder is at maximum is detected during each data sampling cycle. The determined fuel-delivery requirement value is modified based upon the detected engine crankshaft position.

27 Claims, 38 Drawing Figures

AIR-FUEL RATIO CONTROL SYSTEM

BACKGROUND OF THE INVENTION

This invention relates to a method and apparatus for the control of the air-fuel ratio of a mixture to an internal combustion engine.

The air-fuel ratio to an internal combustion engine has been controlled by calculating a value of fuel-delivery requirement for the engine as a function of engine load and modifying the calculated fuel-delivery requirement value based upon various correction factors determined from engine operating parameters including battery voltage, cylinder-head coolant-temperature, engine speed, etc. Such conventional air-fuel ratio control is satsifactory as long as the air-fuel ratio to the engine is adjusted at the stoichiometric value, but it has been found that a limitation is encountered in attempting to improve fuel economy since the air-fuel ratio cannot be controlled at a desired lean value without deteriorating engine operation stability.

Therefore, the present invention provides a method and apparatus for controlling the air-fuel ratio to an engine which can improve fuel economy to a considerable extent without deteriorating engine operation stability.

SUMMARY OF THE INVENTION

There is provided, in accordance with the present invention, a method of controlling the air-fuel ratio of a mixture to an internal combustion engine. The method comprises the steps of detecting an engine load condition, determining, in response to the detected engine load condition, a value of fuel-delivery requirement for the engine, and detecting variations of pressure in at least one cylinder. An engine crankshaft position $\theta_{pmax}$ at which the pressure in the cylinder is at maximum is detected during each pressure detecting cycle. The determined fuel-delivery requirement value is modified based upon the detected engine crankshaft $\theta_{pmax}$.

Preferably, the determined fuel-delivery requirement value is modified by comparing the detected engine crankshaft position $\theta_{pmax}$ with a lower and upper limit, detecting the number N1 of times the detected engine crankshaft position $\theta_{pmax}$ is greater than the upper limit and the number N2 of times the detected engine crankshaft position $\theta_{pmax}$ is smaller than the lower limit during each cycle of a predetermined number of rotations of the engine crankshaft, and modifying the determined fuel-delivery requirement value based upon the detected numbers N1 and N2.

The determined fuel-delivery requirement value may be modified by detecting one of four engine operating conditions of late combustion, early combustion, unstable engine operation, and stable engine operation based upon the detected numbers N1 and N2; modifying the determined fuel-delivery requirement value to enrich the air-fuel ratio immediately in response to the detected late combustion or the detected unstable engine operation, to lean out the air-fuel ratio immediately in response to the detected early combustion, and to lean out, at the end of the predetermined number of rotations of the engine crankshaft, the air-fuel ratio in response to the detected stable engine operation.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Prior to the description of the preferred embodiments of the present invention, the prior art air-fuel ratio control system will be briefly described in order to specifically point out the disadvantages attendant thereon.

Figure 1:
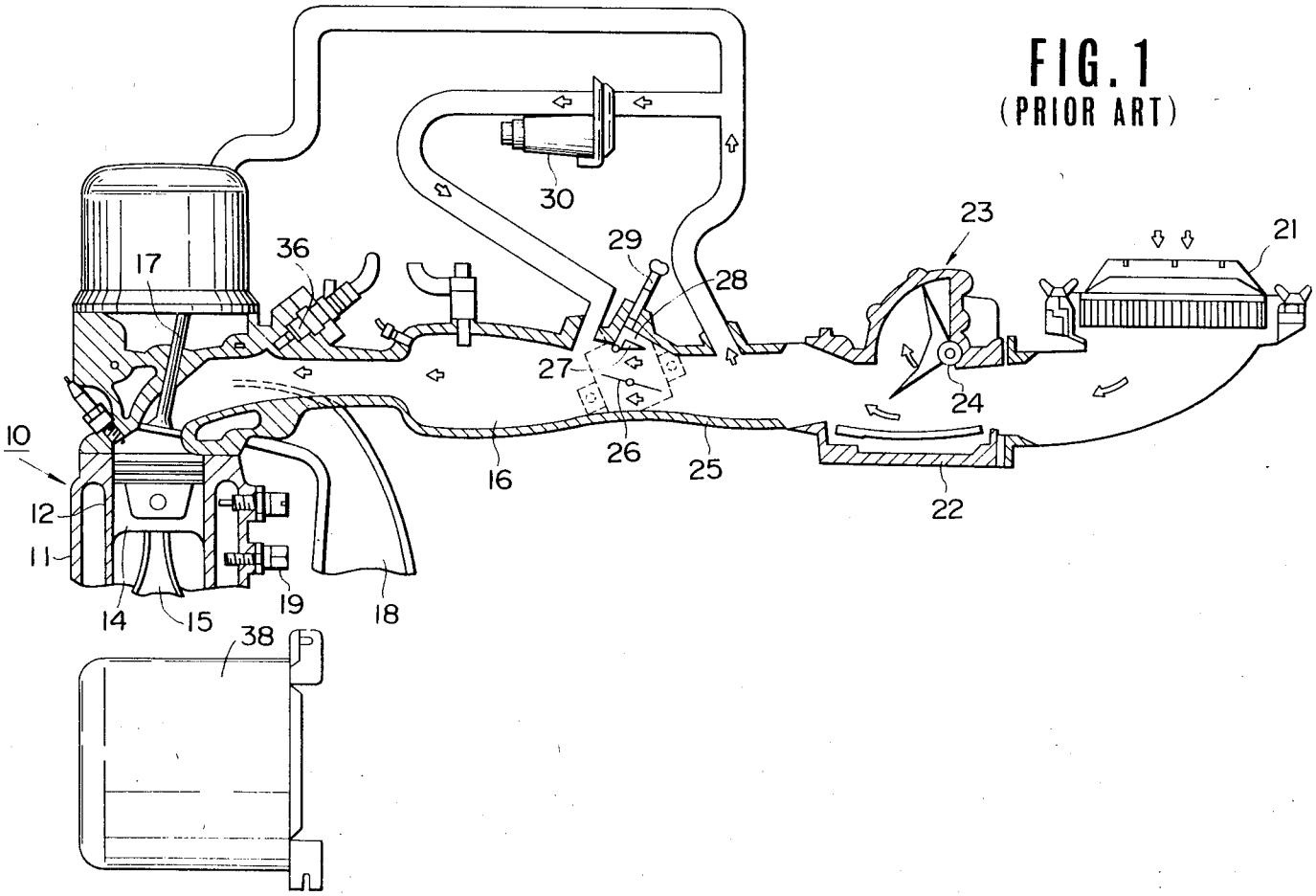
FIG. 1 (PRIOR ART)
FIG. 1 is a schematic sectional view showing a prior art engine with a system for delivery of air to the engine.
Figure 2:
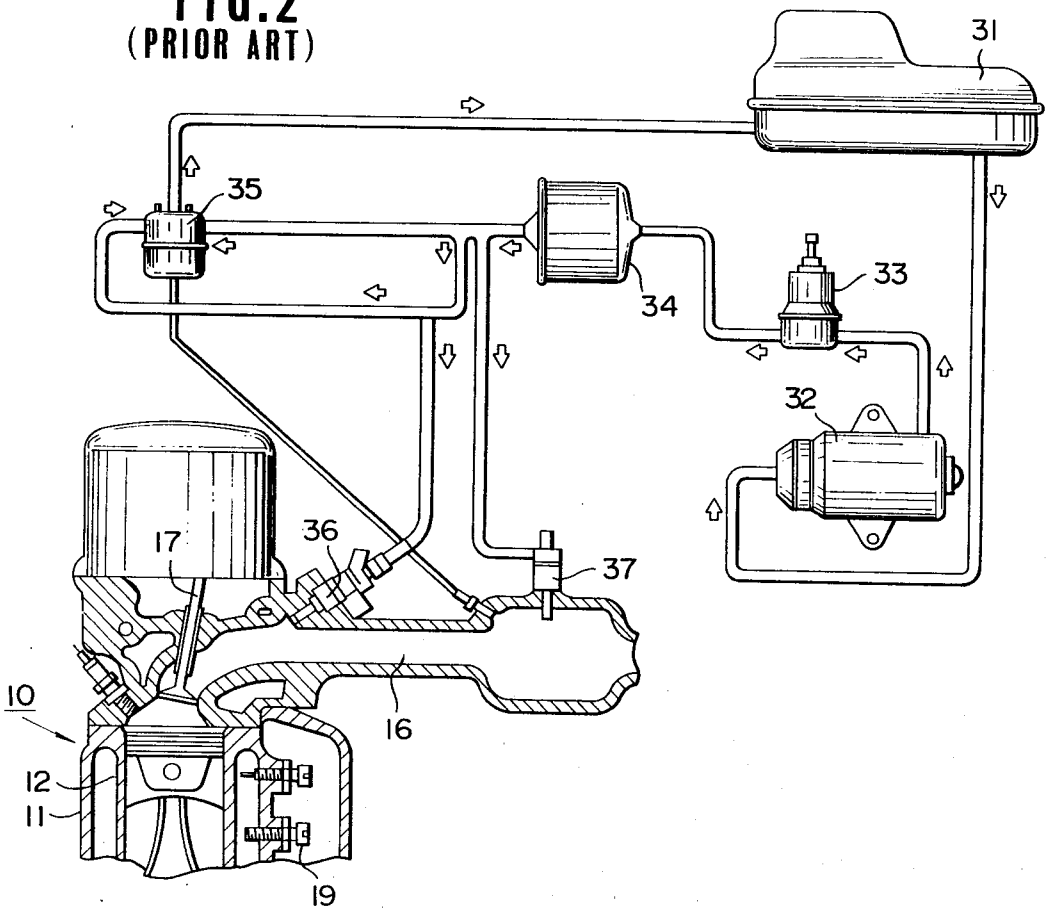
FIG. 2 (PRIOR ART)
FIG. 2 is a schematic sectional view showing the prior art engine with a system for delivery of fuel to the engine.

Referring to FIGS. 1 and 2, there is shown an internal combustion engine 10 which comprises an engine block 11, water-cooled cylinders 12 each defining at its head end a combustion chamber within which a piston 14 is adapted to reciprocate, and a connecting rod 15 drivingly connecting the piston 14 to the crankshaft (not shown). The combustion chamber is supplied with a combustible gas, particularly an air-fuel mixture from an intake manifold 16, through a suitable inlet port having an intake valve 17 associated therewith, and the exhaust gases are suitably discharged through a further port having an exhaust valve associated therewith to an exhaust manifold 18. A cylinder-head coolant temperature sensor 19 is mounted in the engine cooling system and is connected in an electrical circuit capable of producing a DC voltage having a variable level proportional to coolant temperature.

Air to the engine 10 is supplied through an air filter 21 and an induction passage 22 in an air flow meter unit, generally designated as 23, and through a throttle controlled air induction unit 25 to the intake manifold 16 of the engine. The air flow meter unit 23 has therein an air flow meter 24 which measures the actual air flow to the engine. The air induction unit 25 has therein a throttle valve 26 which is drivingly connected to an accelerator pedal for controlling the flow of air into the intake manifold 16 of the engine. A throttle switch 27 closes to generate a signal indicating idle conditions upon closure of the throttle valve 26. The reference numeral 28 designates a bypass passage through which air is supplied into the intake manifold 16 of the engine at idle conditions where the throttle valve 26 is at its closed position. The flow of air through the bypass passage 28 is controlled by the position of an idle adjuster screw 29. An air regulator 30 is also provided which controls the flow of air into the intake manifold 16 when the engine is starting or being warmed.

Referring to FIG. 2, fuel for the engine is delivered by a fuel pump 32 from a fuel tank 31 through a filter 34 to individual fuel injectors 36 for each of the cylinders of the engine, only one fuel injector being shown as opening toward the intake valve 17. A fuel pulsation damper 33 is provided between the fuel pump 32 and the filter 34 for damping or suppressing fuel pulsations produced by the fuel pump 32. The pressure of fuel to the fuel injectors 36 is regulated at a constant value by a pressure regulator 35. The fuel injectors 36 may be of any suitable type so that fuel is metered by controlling the injection duration from each injector for the individual combustion chambers as controlled by an electric fuel injection controller 38 (shown in FIG. 1) as a function of engine operating conditions in a manner to be described. The reference numeral 37 designates a cold-start fuel-injector which opens at low engine temperatures to furnish an extra charge of fuel so as to enrich the mixture for starting a cold engine.

The fuel injection controller 38 (FIG. 1) controls the air-fuel ratio to the engine by measuring the actual engine air flow and proportioning the fuel to the air flow. The fuel is metered by controlling the duration of injection from each injector at the individual engine cylinders. The air flow is measured by means of the air flow meter 24. The total air flow is used to determine the air flow per cycle by taking into account the engine speed and the number of cylinders of the engine. The engine speed in terms of the engine crankshaft speed is sensed by an engine speed and timing transducer (not shown) to provide a signal of engine speed and a basic synchronization signal for the fuel injection as a function of the engine operating cycle. The desired air-fuel ratio is modified as a function of engine temperature, engine speed, battery voltage, and/or the lapse of time after the engine starter is turned on. The fuel injection controller 38 receives a signal from the engine starter, a signal of engine temperature from the temperature sensor 19, a signal of engine air flow from the air flow meter 24, a signal of engine speed from the engine speed and timing transducer, a signal from the throttle switch 27, and a signal of battery voltage.

The amount of fuel metered to each cylinder, this being determined by the width of the electrical pulses applied to the fuel injectors, is repetitively determined by the fuel injection controller 38. The fuel-injection pulse-width T is calculated as a function of engine air flow Q and engine speed N as $T=K.(Q/N)$ and modified based upon various correction factors Ts, Ft, KAs and Kai.

Figure 3:
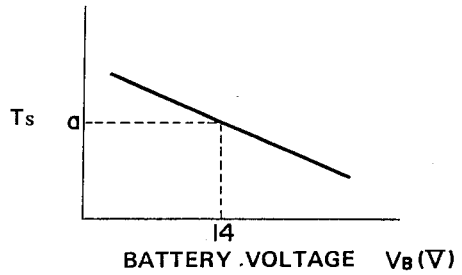
FIGS. 3–9 are graphs used in determining correction factors for modification of a calculated value of fuel-delivery requirement for the engine.

The correction factor Ts, which is used to compensate for variation of voltage of the battery as shown in FIG. 3, is given by $$Ts=a+b(14-V_B)$$

wherein a and b are constants and $V_B$ is the voltage of the battery by which the fuel injectors are driven.

Figure 4:
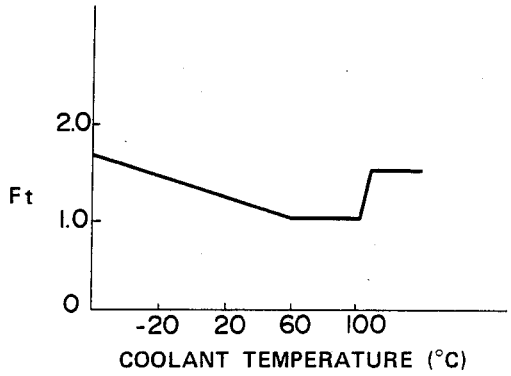

The coolant-temperature correction factor Ft, which is used when the engine is not warmed sufficiently, is obtained from the characteristic curve of FIG. 4.

Figure 5:
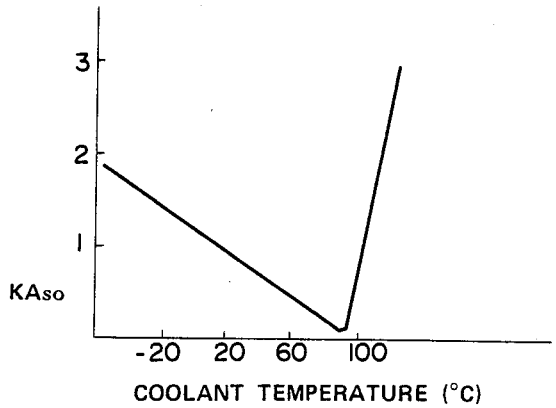

The correction factor KAs, which is used to supply additional fuel so as to provide smooth engine start and smooth transition to an idle condition, decreases to zero with the lapse of time. The correction factor KAs is at a variable initial value KAso when the engine starter is turned on. The initial value KAso varies as a function of coolant temperature as shown in FIG. 5.

Figure 6:
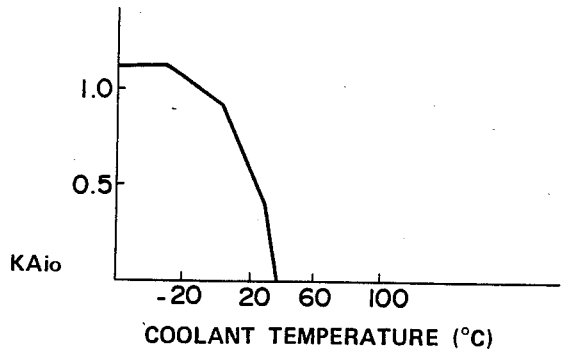

The correction factor KAi, which is used to furnish additional fuel so as to provide smooth engine start when the engine is not warmed sufficiently, decreases to zero with the lapse of time. The correction factor KAi is at a variable initial value KAio when the throttle switch 27 opens. The initial value KAio varies as a function of coolant temperature as shown in FIG. 6.

The fuel-injection pulse-width T may also be modified based upon the output of an exhaust gas sensor located in the exhaust passage from the engine.

Figure 7:
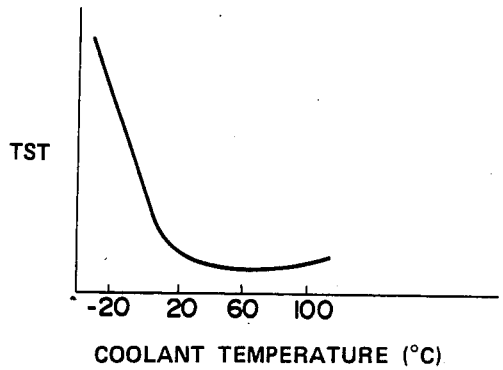
Figure 8:
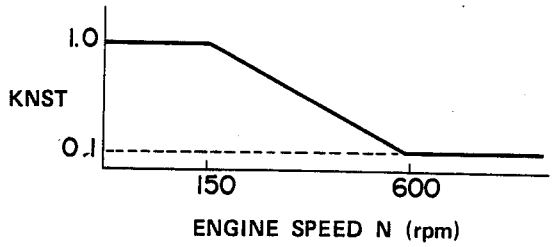
Figure 9:
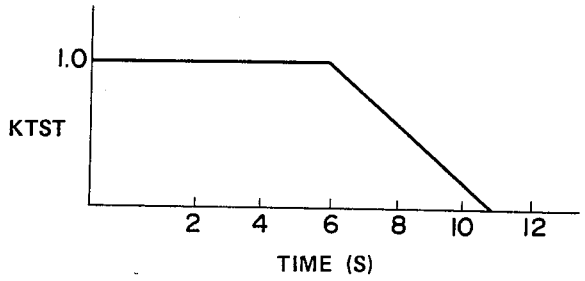

When the engine is starting, the fuel-injection pulse-width T is determined by the choice of greater one of $$Ti=(K.(Q/N).(1+KAs)\times 1.3+Ts \text{ and } T2=TST\times KNST\times KTST,$$

wherein TST varies as a function of cylinder-head coolant-temperature as shown in FIG. 7, KNST varies as a function of engine speed as shown in FIG. 8, and DTST varies with the lapse of time after the engine starter is turned on as shown in FIG. 9.

Figure 10:
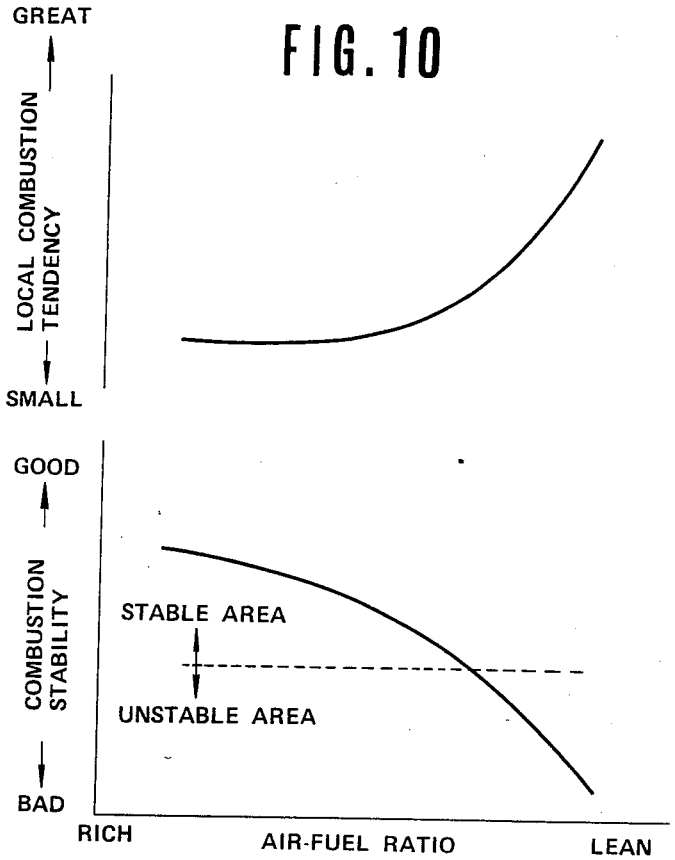
FIG. 10 is a graph showing the degree of combustion stability as a function of the air-fuel ratio of a mixture to an engine.

Such a prior art air-fuel ratio control system is satisfactory in providing stable combustion as long as the air-fuel ratio to the engine is controlled near the stoichiometric value. However, such air-fuel ratio control introduces a limitation on improvement in fuel economy. An attempt to reduce fuel consumption by controlling the air-fuel ratio on the lean side will cause an increase in the tendency toward local combustion and unstable combustion. The leaner the air-fuel ratio to the engine, the greater the tendency toward local combustion and the less the combustion stability as shown in FIG. 10. Accordingly, it is necessary to control the air-fuel ratio at a desired value such that the engine operation stability is within a tolerable range. With conventional air-fuel ratio control systems, however, it is impossible to control the air-fuel ratio to the engine at a desired lean value while maintaining good engine operation stability due to poor manufacturing accuracy of the air flow meter and errors occurring upon installing the air flow meter to the engine.

Figure 11:
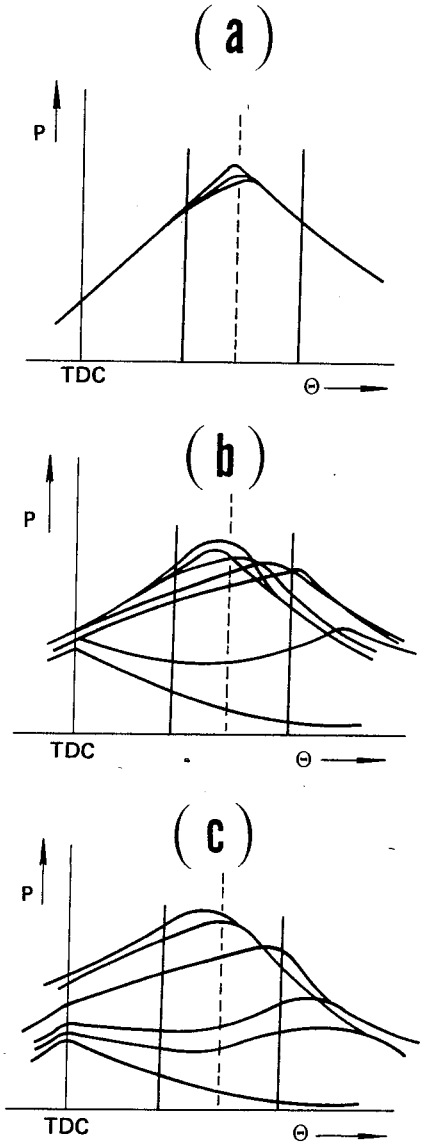
FIGS. 11*a*, 11*b* and 11*c* show variations of the pressure in one cylinder of an engine at three different air-fuel ratios for the same engine operating conditions.
Figure 12:
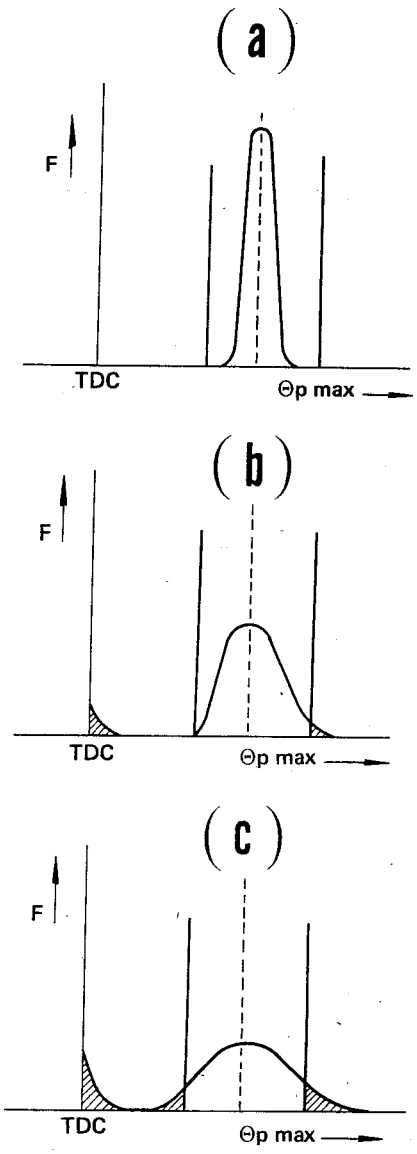
FIGS. 12*a*, 12*b* and 12*c* show the frequencies of engine crankshaft positions at which the pressure in one cylinder of an engine reaches its maximum value at three different air-fuel ratios for the same engine operating conditions.
Figure 13:
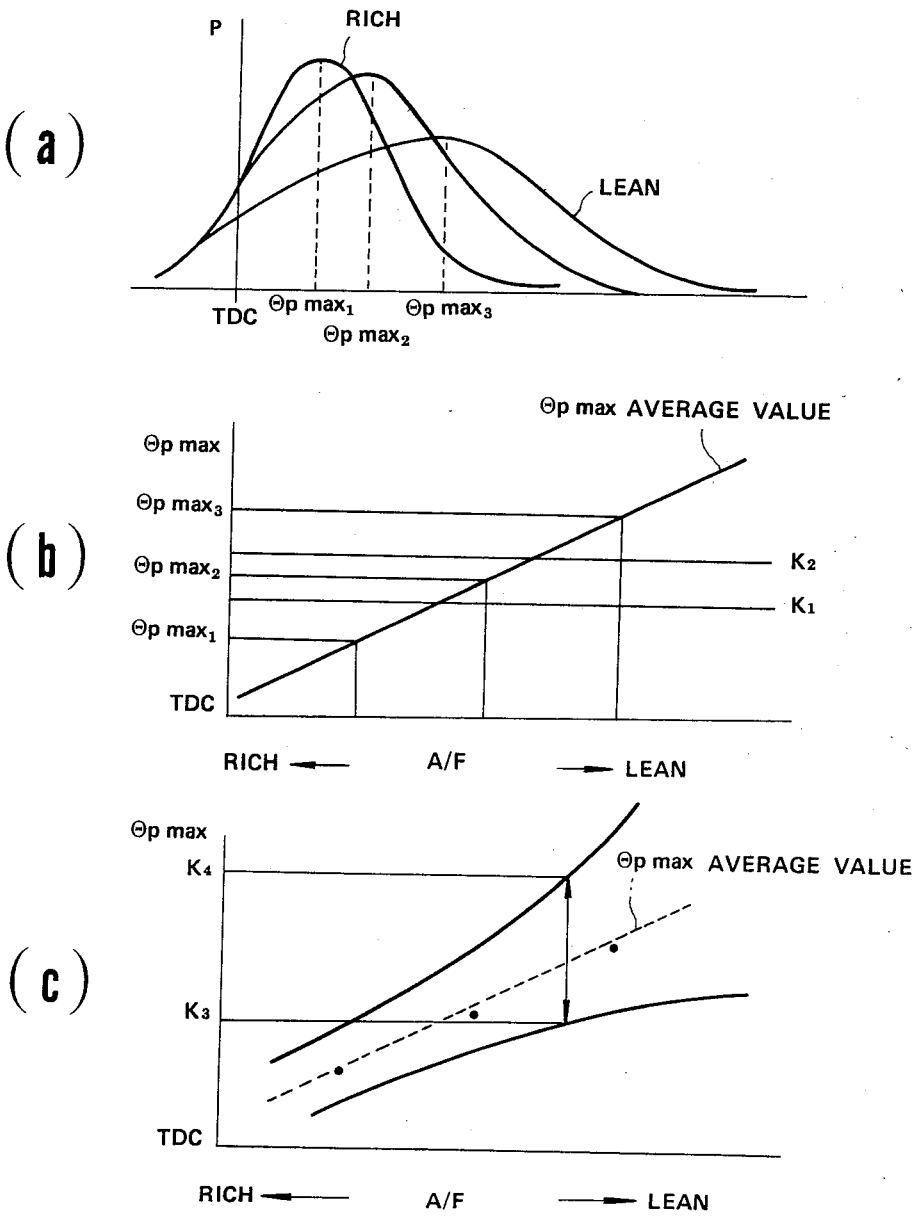
FIGS. 13*a*, 13*b* and 13*c* showing the relation of the engine crankshaft position $\theta_{pmax}$ at which the pressure in one engine cylinder is at maximum with respect to different air-fuel ratios.

In order to compare the dispersion of the engine crankshaft position $\theta_{pmax}$ at which the pressure in one engine cylinder reaches its maximum value at three different air-fuel ratios (greater than 15), reference is made to FIGS. 11, 12 and 13. FIGS. 11*a*, 11*b* and 11*c* show pressure profiles in one engine cylinder at different air-fuel ratios R1, R2 and R3 (R1<R2<R3), respectively. FIGS. 12*a*, 12*b* and 12*c* are curves of engine crankshaft position $\theta_{pmax}$ versus frequency F at different air-fuel ratios R1, R2 and R3 (R1<R2<R3), respectively. FIGS. 13*a*, 13*b* and 13*c* show the relation between the engine crankshaft position $\theta_{pmax}$ and the air-fuel ratio (A/F). As can be seen by a study of FIGS. 11, 12 and 13, the leaner the air-fuel ratio to the engine, the wider the range in which the engine crankshaft position $\theta_{pmax}$ is dispersed, the later combustion occurs, and the greater the engine crankshaft position $\theta_{pmax}$. An increase in the frequency at which the engine crankshaft position $\theta_{pmax}$ exceeds a predetermined value will results in unstable engine operation.

Figure 14:
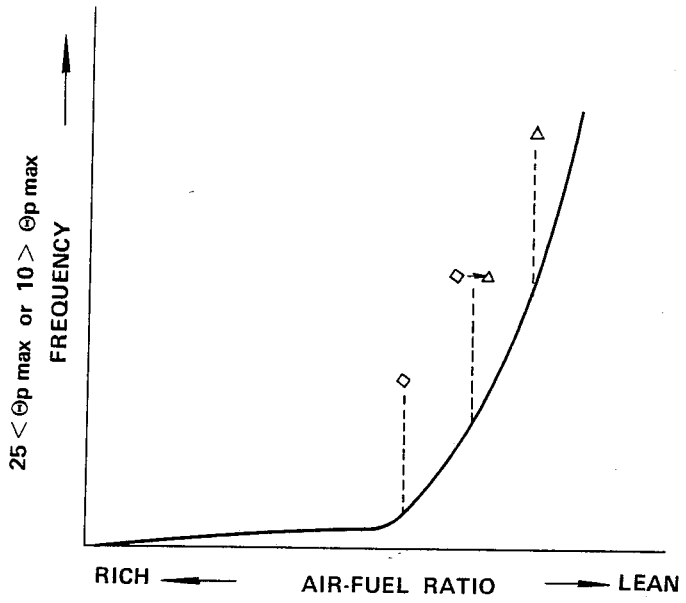
FIG. 14 is a graph showing the frequencies of the engine crankshaft position $\theta_{pmax}$ out of the range of predetermined limits with respect to different air-fuel ratios.

FIG. 14 is a graph plotting the frequency at which the engine crankshaft position $\theta_{pmax}$ is out of the range of 10° ATDC to 25° ATDC, wherein ◇ indicates good engine operation stability and Δ indicates almost good engine operation stability. As can be understood by reference to FIG. 14, engine operation stability can be ensured by controlling the air-fuel ratio based upon the frequency at which the engine crankshaft position $\theta_{pmax}$ is out of a range defined by a lower and upper limit.

Figure 15:
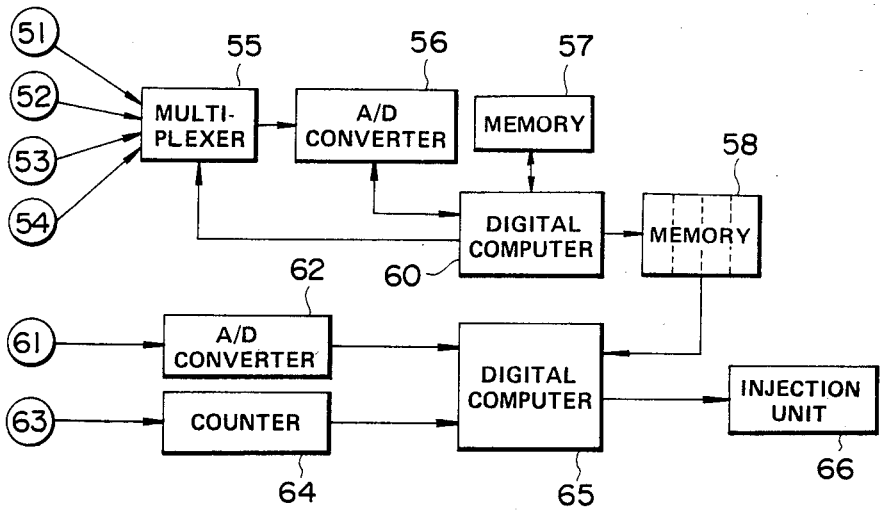
FIG. 15 is a block diagram showing one embodiment of an air-fuel ratio control system of the present invention.

FIG. 15 illustrates one embodiment of an air-fuel ratio control system made in accordance with the present invention. While the present invention will be described in conjunction with a four-cylinder engine operating on a four-stroke Otto cycle, it is understood that the invention could be readily applied to any engine structure. In addition, while the sequence or order of ignition of the engine is considered as Cylinder No. 1, Cylinder No. 3, Cylinder No. 4, and Cylinder No. 2, there is no intention to be limited to such ignition order.

Referring to FIG. 15, the reference numerals 51 to 54 designate pressure sensors having a pressure transducer which senses the variations of pressure of the gases in each cylinder when the engine is running and generates an analog signal corresponding thereto. The pressure transducer may have a piezo-electric element taken in the form of a washer through which a spark plug is mounted in the top of the cylinder. Alternatively, the pressure transducer may have a piezo-electric element taken in the form of a gasket mounted between the cylinder head and the cylinder block. The first pressure sensor 51 measures the pressure in Cylinder No. 1, the second pressure sensor 52 measures the pressure in Cylinder No. 2, the third pressure sensor 53 measures the pressure in Cylinder No. 3, and the fourth pressure sensor 54 measures the pressure in Cylinder No. 4.

The outputs of the pressure sensors 51–54 are coupled to an analog multiplexer 55 which selectively connects one of the pressure sensors to an analog-to-digital converter 56 in conjunction with engine crankshaft position under the control of a first digital computer 60. The pressure values of the selected analog signal are, one by one, converted by the analog-to-digital converter 56 into digital form at one degree of rotation of the engine crankshaft and read into a first memory 57 under the control of the first digital computer 60. The A to D conversion may be performed at a predetermined number of degrees of rotation of the engine crankshaft. The first memory 57 stores signals with values indicative of the sampled pressure P in relation to the number of degrees of rotation of the engine crankshaft $\theta$ at which the corresponding pressure values are sampled. The first digital computer 60 is also associated with a second memory 58 which has four limit counters each including a lower limit and upper limit counter.

Upon completion of the conversion or data sampling cycle for one cylinder, the first digital computer 60 reads the data out of the first memory 57 and calculates the number of degrees of rotation of the engine crankshaft $\theta_{pmax}$ at which the maximum pressure value is sampled. The first digital computer 60 compares the calculated crankshaft position $\theta_{pmax}$ with predetermined lower and upper limits K1 and K2. The first digital computer 60 causes the lower limit counter of the corresponding limit counter to count up by one step when the calculated crankshaft position $\theta_{pmax}$ is below the predetermined lower limit K1. The first digital computer 60 causes the upper limit counter of the limit counter to count up by one step when the calculated crankshaft position $\theta_{pmax}$ is above the predetermined upper limit K2.

Figure 16:
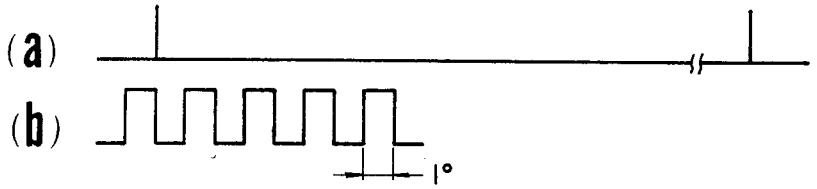
FIGS. 16*a* and 16*b* illustrate voltage waveforms showing the voltages and their timed relationship developed by the crankshaft position sensor and a reference pulse generator in FIG. 15.

The reference numeral 61 designates an air flow meter which measures the actual air flow to the engine and generates an analog signal corresponding thereto. The output of the air flow meter 61 is converted by an analog-to-digital converter 62 into digital form for application to a second digital computer 65. The reference numeral 63 designates a crankshaft position sensor and a reference pulse generator which produces a series of crankshaft position electrical pulses, as shown in FIG. 16*b*, each corresponding to one degree of rotation of the engine crankshaft, of a repetition rate directly proportional to engine speed and a reference electrical pulse, as shown in FIG. 16*a*, at the top dead center position of the engine piston of Cylinder No. 1. The crankshaft position electrical pulses are fed to a counter 64 which generates a signal indicative of engine speed N to the second digital computer 65.

Briefly summarized, the second digital computer 65 calculates the width of electrical pulses to fuel injectors for the respective cylinders by calculating a basic value $T_p$ of fuel delivery requirements in the form of fuel-injection pulse-width as a function of engine intake air flow Q and engine speed N, calculating a correction factor $\alpha$ based upon the counts of the lower and upper limit counters of the four limit counters, and multiplying the calculated basic value $T_p$ by the calculated correction factor $\alpha$.

The second digital computer 65 detects delayed or late combustion and sets the correction factor $\alpha$ at $1+K_{R1}$ so as to immediately enrich the air-fuel ratio to the engine when at least one of the counts of the four upper limit counters reaches a predetermined value, for example, 3 and all of the counts of the four lower limit counters are zero during a predetermined number, for example, 24 of rotations of the engine crankshaft, or when the number of the upper limit counters whose counts are 1 or more reaches a predetermined value, for example, 3 and all of the counts of the lower limit counters are zero during the predetermined number of rotations of the engine crankshaft. The second digital computer 65 detects advanced or early combustion and sets the correction factor $\alpha$ at $1-K_{L1}$ so as to immediately lean out the air-fuel ratio when at least one of the counts of the lower limit counters reaches a predetermined value, for example, 3 and all of the counts of the upper limit counters are zero during a predetermined number, for example, 24 of rotations of the engine crankshaft, or when the number of the lower limit counters whose counts are 1 or more reaches a predetermined value, for example, 3 and all of the counts of the upper limit counters are zero during the predetermined number of rotations of the engine crankshaft. The number of rotations of the engine crankshaft is detected by a rotation counter (not shown) which advances by one step every rotation of the engine crankshaft.

Furthermore, the second digital computer 65 detects that engine operation stability is degraded or is closed to a tolerable limit and sets the correction factor $\alpha$ at $1+K_{R2}$ so as to immediately enrich the air-fuel ratio to the engine when at least one of the counts of the lower and upper limit counters of the four limit counters reaches a predetermined value, for example, 3 and at least one of the counts of the lower limit counters is not zero and at least one of the counts of the upper limit counters is not zero during a predetermined number, for example 24 of rotations of the engine crankshaft, or when the number of the lower and upper limit counters whose counts are 1 or more reaches a predetermined value, for example, 3 and at least one of the counts of the lower limit counters is 1 or more and at least one of the counts of the upper limit counters is 1 or more during the predetermined number of rotations of the engine crankshaft. The second digital computer 65 detects sufficient engine operation stability and sets the correction factor $\alpha$ at $1-K_{L2}$ so as to lean out the air-fuel ratio to the engine at the end of the period corresponding to the predetermined number of rotation of the engine crankshaft and then resets all of the lower and upper limit counters to zero when the number of the lower and upper limit counters whose counts are 1 or more does not reach a predetermined value, for example, 3 and all of the counts of the lower and upper limit counters do not reach a predetermined value, for example, 3 during a predetermined number, for example, 24 of rotations of the engine crankshaft. The result of calculation of fuel-injection pulse-width T is fed to a fuel injection unit 66.

Figure 17:
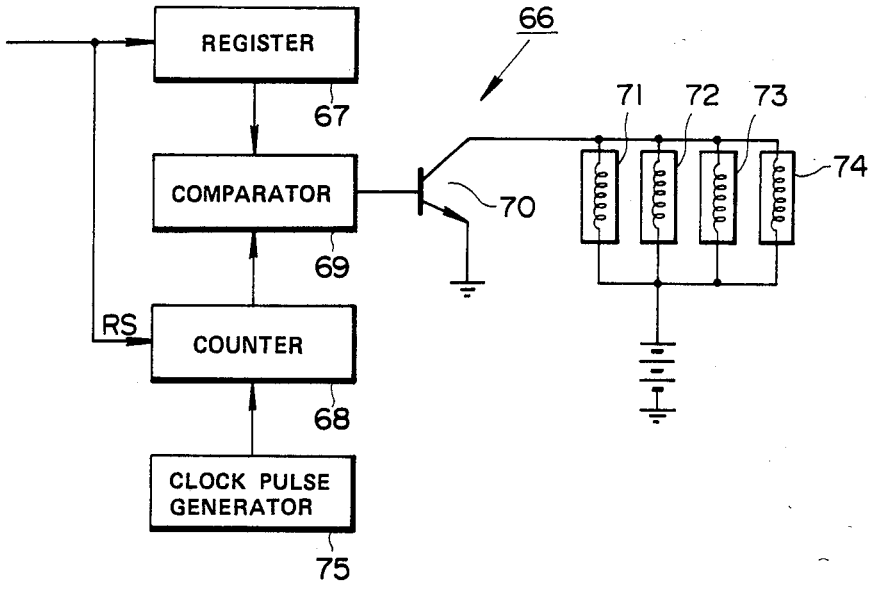
FIG. 17 is a block diagram showing the detail of the fuel injection unit in FIG. 15.
Figure 18:
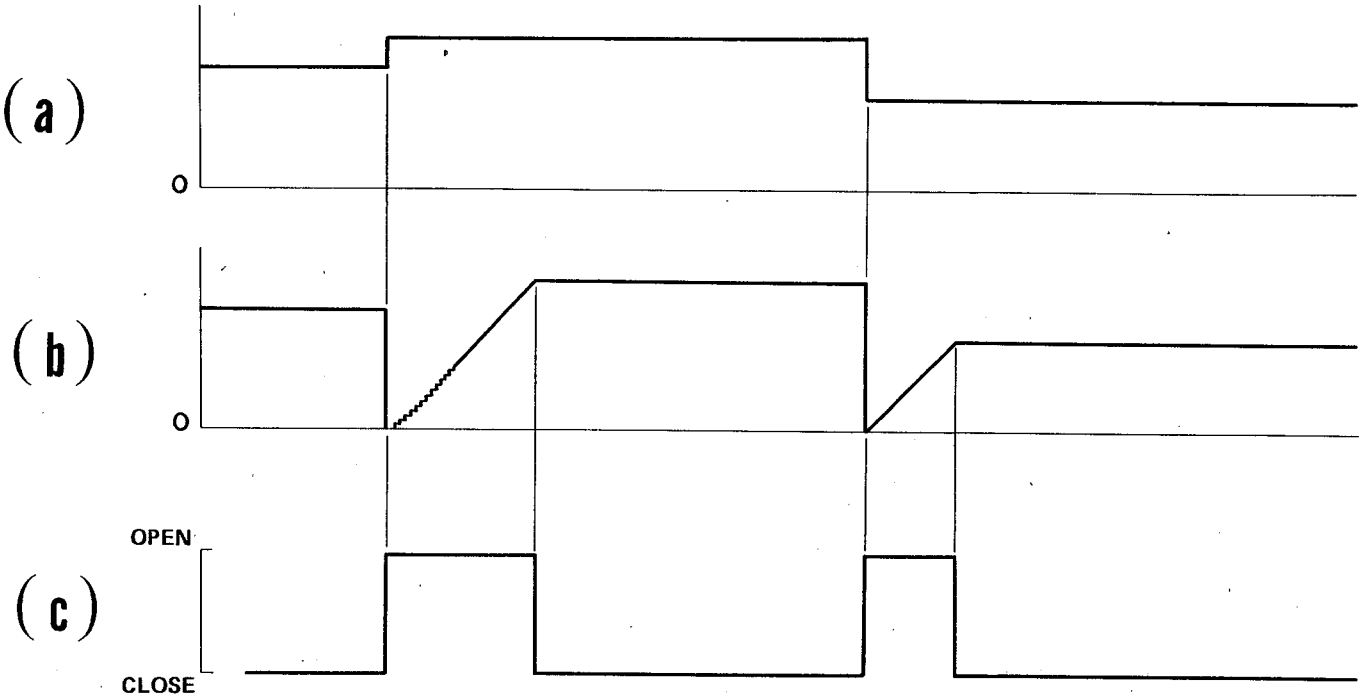
FIGS. 18*a*, 18*b* and 18*c* illustrate voltage waveforms showing the various voltages and their timed relationship developed by the components of the fuel injection unit in FIG. 17.

Referring to FIG. 17, the fuel injection unit 66 includes a register 67, a counter 68 and a comparator 69. The output of the comparator 69 is coupled to the base of a transistor 70 whose emitter is grounded. The collector of the transistor 70 is connected to fuel injectors 71–74 for delivery of fuel into the respective cylinders. The register 67 stores, on command from the second digital computer 65, a value which corresponds to the calculated fuel-injection pulse-width T transferred thereto from the second digital computer, as shown in FIG. 18*a*. Upon completion of transfer of the fuel-injection pulse-width T into the register 67, the comparator 69 provides an "on" signal to turn the transistor 70 on, causing the fuel injectors 71–74 to start fuel injection, as shown in FIG. 18*c*, and at the same time the counter 68 is reset to zero and starts counting clock pulses from a clock pulse generator 75, advancing the count from zero at a predetermined rate, as shown in FIG. 18*b*. When the count of the counter 68 reaches a value which corresponds to the value stored in the register 67, the comparator 69 ceases to provide the "on" signal to the transistor 70 so as to stop fuel injection, as shown in FIG. 18*c*, and also causes the counter 68 to stop counting clock pulses, as shown in FIG. 18*b*.

Figure 19:
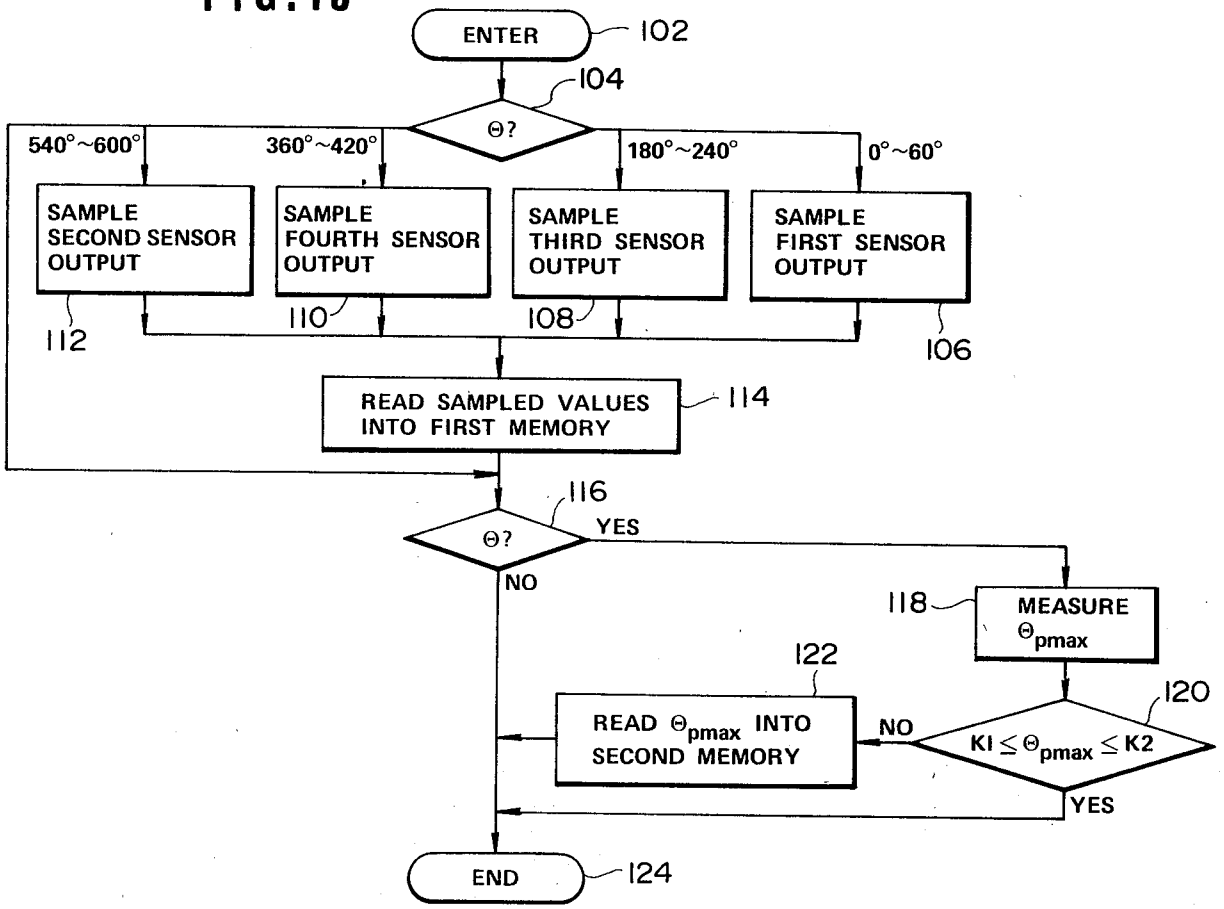
FIG. 19 is a flow diagram of the programming of the first digital computer in FIG. 15.

FIG. 19 is a flow diagram of the programming of the first digital computer 60. The computer program is entered at the point 102. At the point 104 in the program, a determination is made as to whether the number of degrees of rotation of the engine crankshaft $\theta$ from the top dead center position of the engine piston of Cylinder No. 1 is in a range of 0° to 60°, 180° to 240°, 360° to 420°, or 540° to 600° for each data sampling cycle of 720° of rotation of the engine crankshaft. If the engine crankshaft position $\theta$ is in the range of 0° to 60°, then the first digital computer 60 causes the analog multiplexer 55 to connect the first pressure sensor 51 to the analog-to-digital converter 56 is at the point 106. Following this, the pressure in Cylinder No. 1 is sampled every degree of rotation of the engine crankshaft. Thus, at the point 114 in the program, the pressure indicative signal from the first pressure sensor 51 is converted into digital form and read into the first memory 57.

At the point 116 in the program, a determination is made as to whether or not the engine crankshaft position $\theta$ reaches 61°. If the answer to this question is "yes", then the program proceeds to the point 118 wherein the first digital computer 60 terminates the sampling of the pressure in Cylinder No. 1 and calculates the engine crankshaft position $\theta_{pmax}$ at which the maximum pressure value is sampled during the data sampling cycle for Cylinder No. 1. Following this, the program proceeds to a determination step at the point 120. The determination at this point is whether or not the calculated engine crankshaft position $\theta_{pmax}$ is within the range between predetermined lower and upper limits K1 and K2. For example, the lower limit K1 may be set at 10° after the top dead center position of the engine piston of Cylinder No. 1, and the upper limit K2 may be set at 25° after the top dead center position of the engine piston of Cylinder No. 1. If the calculated engine crankshaft position $\theta_{pmax}$ is smaller than the lower limit K1 or is larger than the upper limit K2, then the program proceeds to the point 122 which will be described later in greater detail.

If the engine crankshaft position $\theta$ is in the range of 180° to 240° at the point 104, then the first, digital computer causes the analog multiplexer 55 to connect the third pressure sensor 53 to the analog-to-digital converter 56 at the point 108. Following this, values indicative of the pressure of the gases in Cylinder No. 3 are sampled every degree of rotation of the engine crankshaft. Thus, at the point 114 in the program, the pressure indicative signal from the third pressure sensor 53 is converted into digital form and read into the first memory 57. At the point 116 in the program, a determination is made as to whether or not the engine crankshaft position $\theta$ reaches 240°. If the answer to this question is "yes", it means that the sampling of the pressure of the gases in Cylinder No. 3 is completed and the program proceeds to the point 118 wherein the first digital computer 60 calculates the engine crankshaft position $\theta_{pmax}$ at which the maximum pressure value is sampled during the data sampling cycle for Cylinder No. 3. At the following point 120, a determination is made as to whether or not the calculated engine crankshaft position $\theta_{pmax}$ is within the range between predetermined lower and upper limits K1 and K2. For example, the lower limit K1 may be set at 10° after the top dead center position of the engine piston of Cylinder No. 3, and the upper limit K2 may be set at 25° after the top dead center position of the engine piston of Cylinder No. 3. If the calculated engine crankshaft position $\theta_{pmax}$ is smaller than the lower limit K1 or is larger than the upper limit K2, then the program proceeds to the point 122.

If the engine crankshaft position $\theta$ is in the range of 360° to 420° at the point 104, then the first digital computer causes the analog multiplexer 55 to connect the fourth pressure sensor 54 to the analog-to-digital converter 56 at the point 108. Following this, values indicative of the pressure of the gases in Cylinder No. 4 are sampled every degree of rotation of the engine crankshaft. Thus, at the point 114 in the program, the pressure indicative signal from the fourth pressure sensor 54 is converted to digital form and read into the first memory 57. At the point 116 in the program, a determination is made as to whether or not the engine crankshaft position $\theta$ reaches 421°. If the answer to this question is "yes", it means that the sampling of the pressure of the gases in Cylinder No. 4 is completed and the first digital computer calculates the engine crankshaft position $\theta_{pmax}$ at which the maximum pressure value is sampled at the point 118. Following this, the program proceeds to a determination step at the point 120. The determination at the point 120 is whether or not the calculated engine crankshaft position $\theta_{pmax}$ is within the range between predetermined lower and upper limits K1 and K2. For example, the lower limit K1 may be set at 10° after the top dead center position of the engine piston of Cylinder No. 4, and the upper limit K2 may be set at 25° after the top dead center position of the engine piston of Cylinder No. 4. If the calculated engine crankshaft position $\theta_{pmax}$ is smaller than the lower limit K1 or is larger than the upper limit K2, then the program proceeds to the point 122.

If the engine crankshaft position $\theta$ is in the range of 540° to 600° at the point 104, then the first digital computer causes the analog multiplexer 55 to connect the second pressure sensor 52 to the analog-to-digital converter 56 at the point 108. Following this, values indicative of the pressure of the gases in Cylinder No. 2 are sampled every degree of rotation of the engine crankshaft. Thus, at the point 114, the pressure indicative signal from the second pressure sensor 52 is converted to digital form and read into the first memory 57. At the point 116 in the program, a determination is made as to whether or not the engine crankshaft position $\theta$ reaches 601°. If the answer to this question is "yes", it means that the sampling of the pressure of the gases in Cylinder No. 2 is completed and the first digital computer calculates the engine crankshaft position $\theta_{pmax}$ at which the maximum pressure value is sampled at the point 118. Following this, the program proceeds to a determination step at the point 120. The determination at the point 120 is whether or not the calculated engine crankshaft position $\theta_{pmax}$ is within the range between predetermined lower and upper limits K1 and K2. For example, the lower limit K1 may be set at 10° after the top dead center position of the engine piston of Cylinder No. 2, and the upper limit K2 may be set at 25° after the top dead center position of the engine piston of Cylinder No. 2. If the calculated engine crankshaft position $\theta_{pmax}$ is smaller than the lower limit K1 or is larger than the upper limit K2, then the program proceeds to the point 122.

Figure 20:
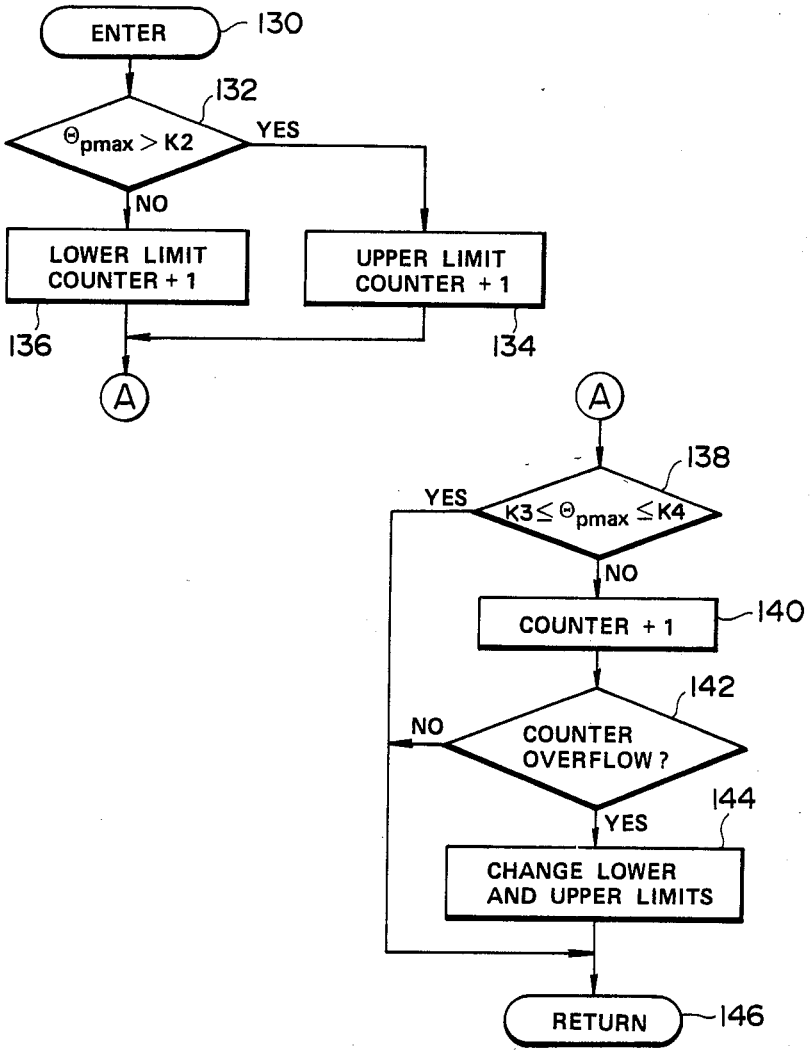
FIG. 20 is a flow diagram showing the detail of one operational step in FIG. 19.

FIG. 20 is a flow diagram showing the details of the operational step performed at the point 122 of FIG. 19 by the first digital computer 60. At the point 130 in FIG. 20, which corresponds to the point 120 of FIG. 19, the computer program is entered. At the point 132, a determination is made as to whether or not the calculated engine crankshaft position $\theta_{pmax}$ is larger than the upper limit K2. If the answer to this question is "yes", then the program proceeds to the point 134 wherein the first digital computer 60 causes the corresponding upper limit counter to count up by one step. If the answer to the question is "no", then it means that the calculated engine crankshaft position $\theta_{pmax}$ is smaller than the lower limit K1 and the program proceeds to the point 136 wherein the first digital computer 60 causes the corresponding lower limit counter to count up by one step.

Following this, the program proceeds to a determination step at the point 138. The determination at this point is whether or not the calculated engine crankshaft position $\theta_{pmax}$ is within a range between predetermined lower and upper limits K3 and K4. The lower limit K3 is smaller than the lower limit K1, and the upper limit K4 is larger than the upper limit K2. If the calculated engine crankshaft position $\theta_{pmax}$ is smaller than the lower limit K3 or is larger than the upper limit K4, then the program proceeds to the point 140 wherein the first digital computer causes an additional counter (not shown) to count up by one step. At the point 142, a determination is made as to whether or not the count of the additional counter reaches a predetermined value for a predetermined period of time and during a predetermined number of rotations of the engine crankshaft. If the answer to this question is "yes", then the lower and upper limits are changed to K1′ and K2′, respectively, at the point 144. The presence of the steps 138 to 144 are optional although they are useful in changing the predetermined lower and upper limits based upon the kind of fuel for the engine.

Figure 21:
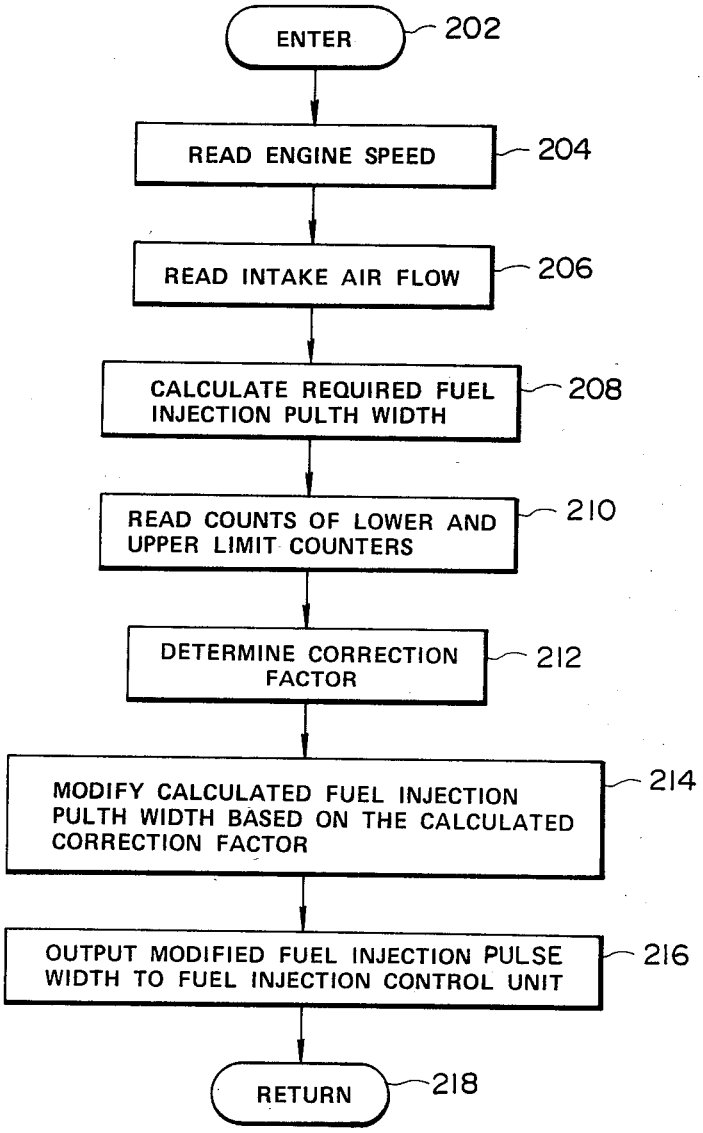
FIG. 21 is a flow diagram of the programming of the second digital computer in FIG. 15.

FIG. 21 is a flow diagram of the programming of the second digital computer 65. The computer program is entered at the point 202. At the point 204 in the program, the engine speed is read into the memory of the second digital computer and at the point 206, the engine intake air flow is read into the computer memory. At the point 208, the second digital computer 65 calculates the fuel-delivery requirement, in the form of fuel-injection pulse-width from an algebraic relationship programmed into the computer. This relationship defines fuel-injection pulse-width T as a function of intake air flow Q and engine speed N as $T=K.(Q/N)$, wherein K is a constant.

At the point 210 in the program, the second digital computer 65 reads the counts of the lower and upper limit counters out of the second memory 58. At the point 212, the correction factor $\alpha$ is calculated based upon the counts of the lower and upper limit counters, as will be described later in more detail. At the point 212, the second digital computer modifies the calculated fuel-injection pulse-width T by multiplying it by the calculated correction factor $\alpha$. At the point 216, the modified value of fuel-injection pulse-width is transferred to the fuel injection unit 66. The fuel injection unit 66 sets the fuel-injection pulse-width according to the modified value for it. At the point 218, the computer program returns to the entry point 202.

Figure 22:
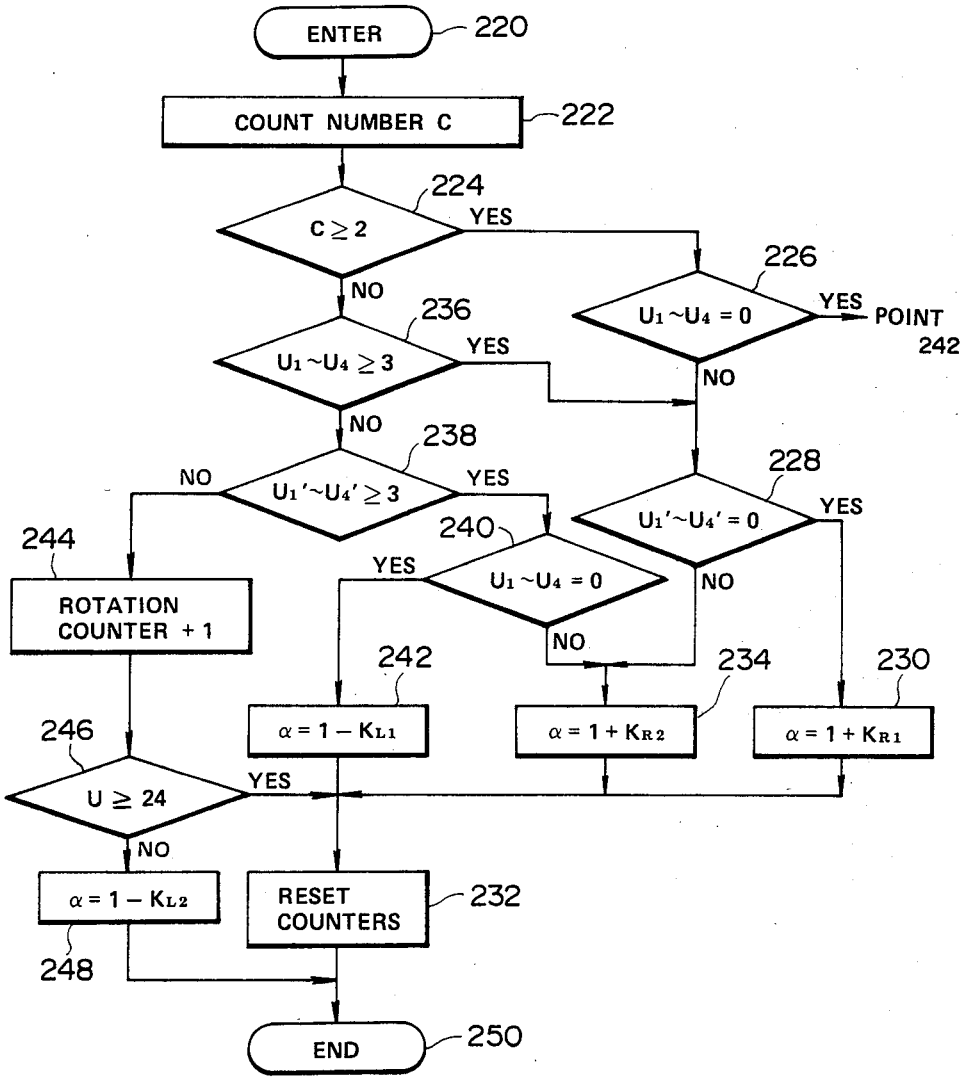
FIG. 22 is a flow diagram illustrating the detail of one operational step in FIG. 21.

FIG. 22 is a flow diagram illustrating the details of the above calculation of correction factor $\alpha$. At the point 220 in FIG. 22, which corresponds to the point 210 of FIG. 21, the computer program is entered. At the point 222 in the program, the second digital computer 65 counts the number C of the limit counters each of which has a lower limit counter accumulating a count equal to 1 or more. At the point 224, a determination is made as to whether or not the number C is equal to or more than 2. If it is, then the program proceeds to another determination step at the point 226. This determination is whether or not all of the counts $U_1$ to $U_4$ of the upper limit counters are zero. If the answer to this question is "yes", then it means that advanced or early combustion is detected and the program proceeds to the point 242 wherein the correction factor $\alpha$ is set at $1-K_{L1}$ so as to lean out the air-fuel ratio to the engine. Following this, the program proceeds to the point 232 wherein the second digital computer resets all of the limit counters to zero and also resets the rotation counter to zero.

However, if at least one of the counts $U_1$ to $U_4$ of the upper limit counters is not zero, then another determination is made at the point 228 as to whether or not all of the counts $U_1'$ to $U_4'$ of the lower limit counters are zero. If it is, then it means that late combustion is detected and the program proceeds to the point 230 wherein the correction factor $\alpha$ is set at $1+K_{R1}$. Following this, the program proceeds to the point 232 wherein the second digital computer resets all of the limit counters to zero and resets the rotation counter to zero. If at least one of the counts $U_1'$ to $U_4'$ of the lower limit counters is not zero, then it means that unstable engine operation is detected and the program proceeds to the point 234 wherein the correction factor $\alpha$ is set at $1+K_{R2}$, and at the point 232, the second digital computer resets all of the limit counters to zero and resets the rotation counter to zero.

If the answer to the question is "no" in the determination step at the point 224, then the program proceeds to a determination step at the point 236. This determination is whether or not at least one of the counts $U_1$ to $U_4$ of the upper limit counters is equal to or more than 3. If the answer to this question is "yes", then the program proceeds to the determination step at the point 228. The details of this determination step and the following steps have been described and will not be repeated here to avoid duplication. Otherwise, another determination is made at the point 238 as to whether or not at least one of the counts $U_1'$ to $U_4'$ of the lower limit counters is equal to or more than 3. If it is, then the program proceeds to a determination step at the point 240. This determination is whether or not all of the counts $U_1$ to $U_4$ of the upper limit counters are zero. If the answer to this question is "yes", then it means that advanced or fast combustion is detected and the program proceeds to the point 242 wherein the correction factor $\alpha$ is set at $1-K_{L1}$, as described previously. However, if at least one of the counts $U_1$ to $U_4$ of the upper limit counters is not zero, then it means that unstable engine operation is detected and the program proceeds to the point 234 wherein the correction factor $\alpha$ is set at $1+K_{R2}$, as described previously.

If the answer to the question is "no" in the determination step at the point 238, then the program proceeds to the point 244 wherein the rotation counter is advanced by one step. At the following step 246, a determination is made as to whether or not the count of the rotation counter reaches a predetermined value, for example, 24. If the answer to this question is "yes", then the program proceeds to the point 232 wherein the second digital computer resets all of the limit counters to zero and resets the rotation counter to zero. Otherwise, the program proceeds to the point 248 wherein the correction factor $\alpha$ is set at $1-K_{L2}$.

Figure 23:
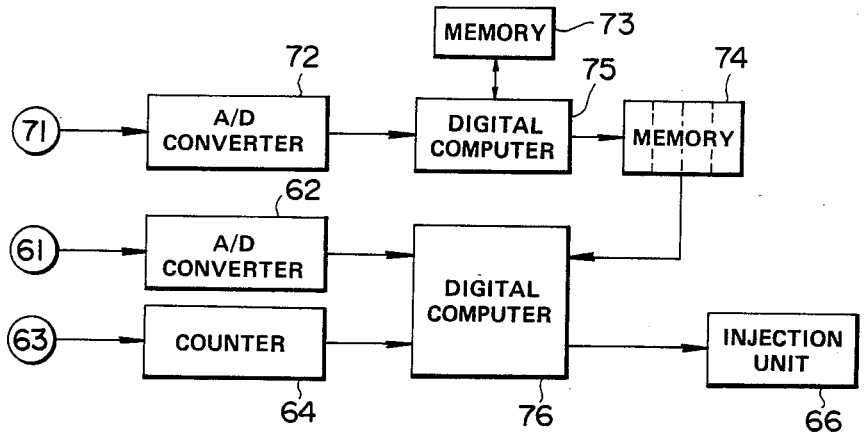
FIG. 23 is a block diagram showing a second embodiment of the present invention.

FIG. 23 illustrates a second embodiment of the air/fuel ratio control system of the present invention wherein like reference numerals have been applied with respect to the equivalent components shown in FIG. 15.

Referring to FIG. 23, the reference numeral 71 designates a single pressure sensor having a pressure transducer which senses the variation of pressure of the gases in Cylinder No. 1 and generates an analog signal corresponding thereto. It is understood, of course, that the pressure sensor may be mounted for a desired one of any of the cylinders. The output of the pressure sensor 71 is coupled to an analog-to-digital converter 72 which converts the pressure indicative analog signal into digital form at every degree of rotation of the engine crankshaft under the control of the first digital computer 75. It is understood that the A to D conversion may be made at a predetermined number of degrees of rotation of the engine crankshaft. The A to D conversion process is initiated on command from the first digital computer 75 when the engine piston of Cylinder No. 1 reaches its top dead center and terminated when the engine crankshaft rotates at an angle of 61° from the top dead center position of the engine piston of Cylinder No. 1. Limiting the conversion cycle within the range of 0° to 60° is effective to separate or eliminate noise which may be superimposed on the detected pressure indicative signal. The converted values are read into a first memory 73 which stores signals with values of sampled pressure P in relation to the number of degrees of rotation of the engine crankshaft $\theta$ at which the corresponding pressure values are sampled.

The first digital computer 75 is also associated with a second memory 74 which has a limit counter including an upper limit and lower limit counter. At the end of the conversion or data sampling cycle or at the end of the compression stroke of the piston, the first digital computer 75 reads the data out of the first memory 73 and calculates the number of degrees of rotation of the engine crankshaft $\theta_{pmax}$ at which the maximum pressure value is sampled. The first digital computer compares the calculated crankshaft position $\theta_{pmax}$ with predetermined lower and upper limits K1 and K2. For example, the lower limit K1 may be set at 10° after the top dead center position of the engine piston of Cylinder No. 1, and the upper limit K2 may be set at 25° after the top dead center position of the engine piston of Cylinder No. 1. The first digital computer 75 causes the lower limit counter to count up by one step when the calculated crankshaft position $\theta_{pmax}$ is below the predetermined lower limit K1 and causes the upper limit counter to count up by one step when the calculated crankshaft position $\theta_{pmax}$ is above the predetermined upper limit K2.

The reference numeral 76 designates a second digital computer which has inputs from the counter 64 and the analog-to-digital converter 62 and calculates the width of electrical pulses to fuel injectors for the respective cylinders by calculating a basic value of fuel delivery requirements in the form of fuel-injection pulse-width T as a function of engine intake air flow Q and engine speed N, calculating a correction factor $\alpha$ based upon the counts of the lower and upper limit counters, and multiplying the calculated basic value by the calculated correction factor $\alpha$.

The operation of the second digital computer 76 is similar to that of the first embodiment except for the manner of calculation of correction factor $\alpha$.

Figure 24:
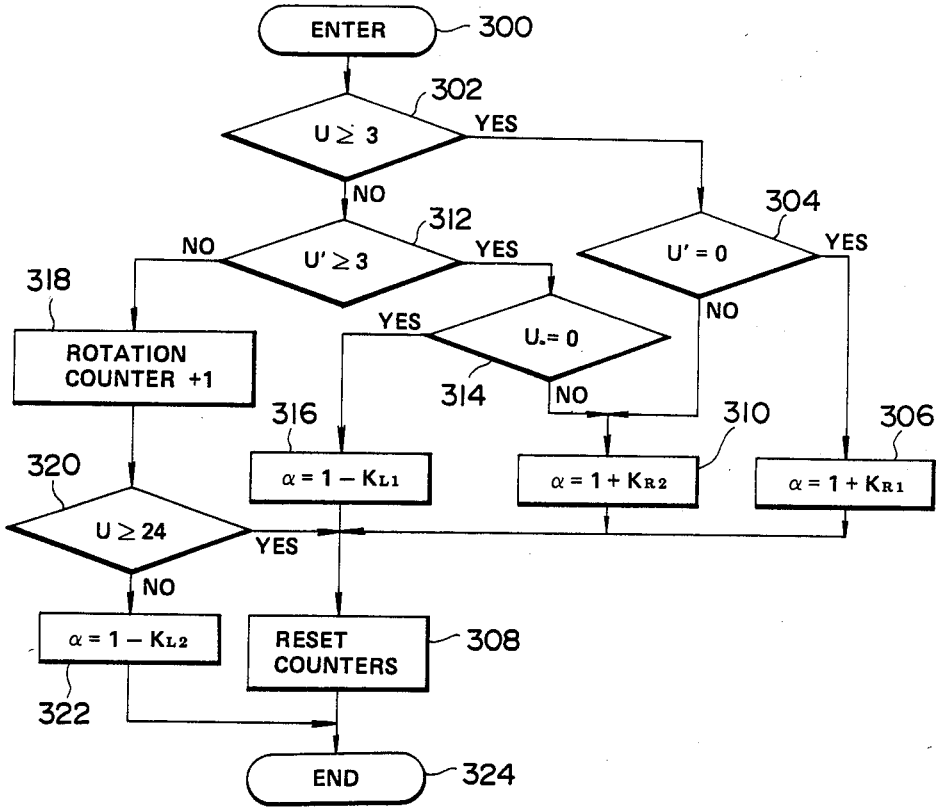
FIG. 24 is a flow diagram of the programming of one operational step in FIG. 21.

FIG. 24 is a flow diagram illustrating the calculation of correction factor $\alpha$ in the second embodiment. At the point 300 in FIG. 24, which corresponds to the point 210 of FIG. 21, the computer program is entered. At the point 302 in the program, a determination is made as to whether or not the count U of the upper limit counter is equal to or more than 3. If the answer to this question is "yes", then the program proceeds to another determination step at the point 304. This determination is whether or not the count U' of the lower limit counter is zero. If the answer to this question is "yes", then it means that delayed or late combustion is detected and the program proceeds to the point 306 wherein the correction factor is set at $x=1+K_{R1}$. Following this, the program proceeds to the point 308 wherein the second digital computer resets the lower and upper limit counters and also resets the rotation counter to zero.

However, if the count U' of the lower limit counter is not zero, then it means that unstable engine operation is detected and the program proceeds to the point 310 wherein the correction factor $\alpha$ is set at $1+K_{R2}$ so as to enrich the air/fuel ratio. Following this, the program proceeds to the point 308 wherein the second digital computer resets the lower and upper limit counters and also resets the rotation counter.

If the answer to the question is "no" in the determination step at the point 302, then another determination is made at the point 312 as to whether or not the count U' of the lower limit counter is equal to or more than 3. If it is, then the program proceeds to a determination step at the point 314. This determination is whether or not the count U of the upper limit counter is zero. If the answer to this question is "no", then it means that unstable engine operation is detected and the program proceeds to the point 310 wherein the correction factor $\alpha$ is set at $1+K_{R2}$, as described previously.

However, if the count U of the upper limit counter is zero, then it means that fast combustion is detected and the program proceeds to the point 316 wherein the correction factor $\alpha$ is set at $1-K_{L1}$ so as to render the air-fuel ratio lean. Following this, the program proceeds to the point 308 wherein the second digital computer resets the lower and upper limit counters to zero and resets the rotation counter to zero.

If the answer to the question is "no" in the determination step at the point 312, then it means that stable engine operation is detected and the program proceeds to the point 318 wherein the rotation counter is advanced by one step. At the point 320, a determination is made as to whether or not the count of the rotation counter reaches a predetermined value, for example, 24. If the answer to this question is "yes", then the program proceeds to the point 308 wherein the second digital computer resets the lower and upper limit counters to zero and resets the rotation counter to zero. Otherwise, the program proceeds to the point 322 wherein the correction factor $\alpha$ is set at $1-K_{L2}$.

Figure 25:
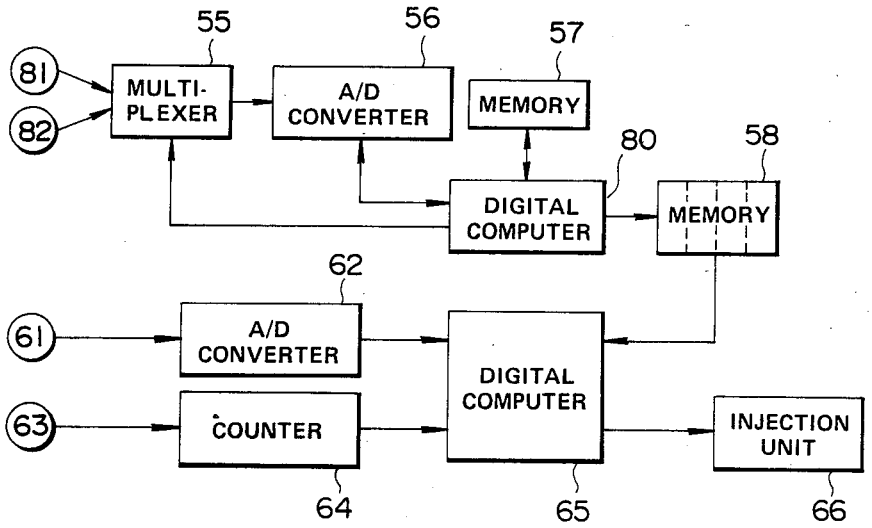
FIG. 25 is a block diagram showing a third embodiment of the present invention.

FIG. 25 illustrates a third embodiment of the present invention which differs from the first embodiment only in that the pressure of the gases in Cylinders No. 1, No. 2, No. 3 and No. 4 is measured by only two pressure sensors 81 and 82. Parts in FIG. 25 which are like those in FIG. 15 have been the same reference numerals.

Figure 26:
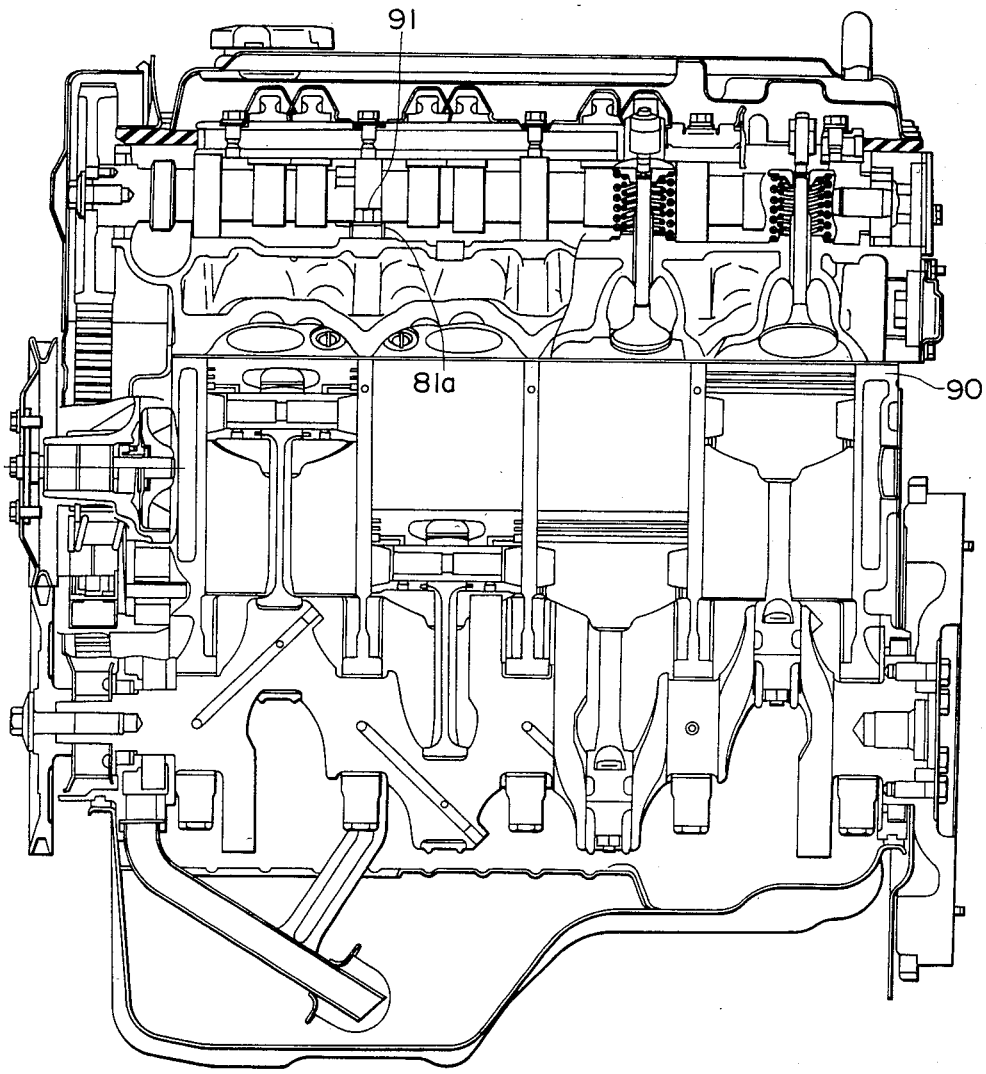
FIG. 26 shows the location of attachment of the pressure sensors used in the air-fuel ratio control system of FIG. 25.

As shown in FIG. 26, the first pressure sensor 81 has a pressure transducer 81*a* which is fixed by one of two head bolts 91 located between Cylinder No. 1 and Cylinder No. 2 for sensing variations of pressure of the gases in Cylinder No. 1 and Cylinder No. 2. The second pressure sensor 82 has a pressure transducer (not shown) which is fixed by one of two head bolts located between Cylinder No. 3 and Cylinder No. 4. The head bolts tightens the respective pressure transducers at the same tightening torque, for example, 7 Kg.m. Preferably, the pressure transducers are fixed by respective head bolts that are located on the intake side rather than on the exhaust side in order to minimize the influence of the temperature of combustion in the corresponding cylinders.

Figure 27:
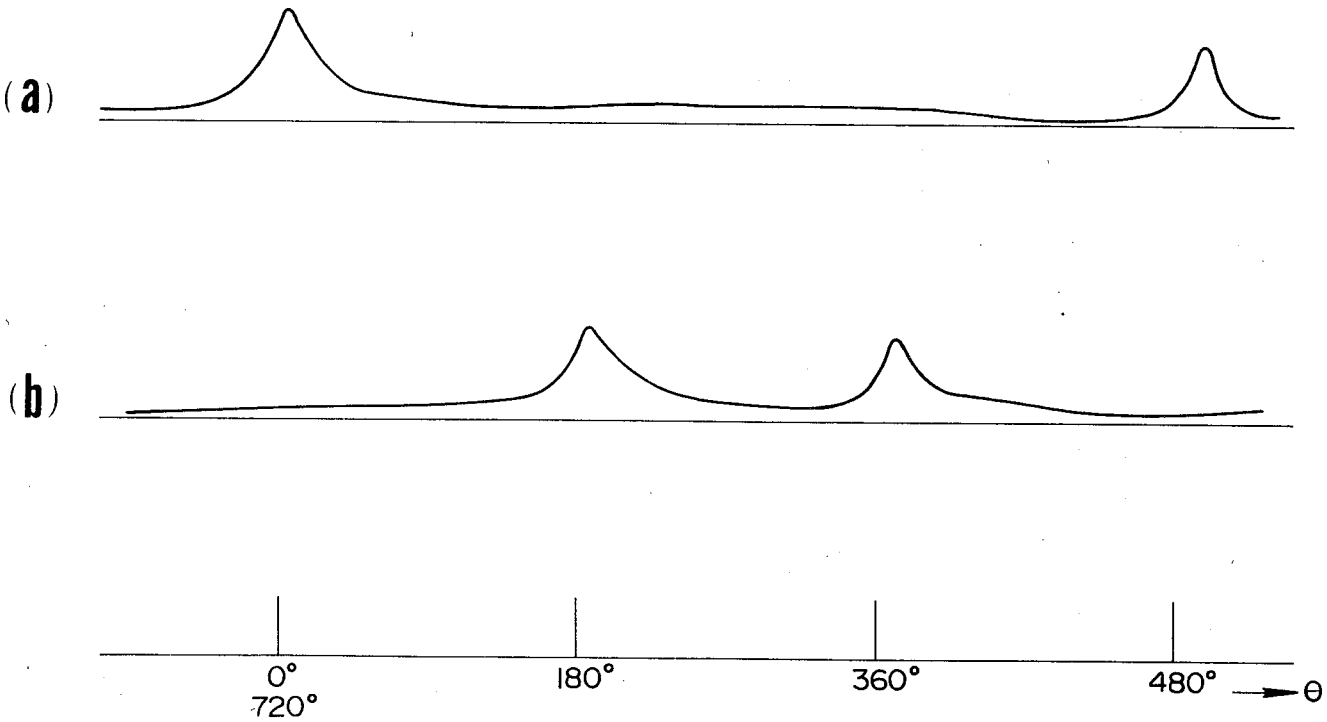
FIGS. 27*a* and 27*b* illustrate voltage waveforms showing the voltages and their timed relationship developed by the pressure sensors in FIG. 25.

The first pressure sensor 81 generates an analog signal indicative of the sensed pressure variations in Cylinder No. 1 and Cylinder No. 2, as shown in FIG. 27*a*. The second pressure sensor 82 generates an analog signal indicative of the sensed pressure variations in Cylinder No. 3 and Cylinder No. 4, as shown in FIG. 27*b*.

Referring back to FIG. 25, the output of the pressure sensors 81 and 82 are coupled to an analog multiplexer 55 which selectively connects one of the pressure sensors 81 and 82 in conjunction with engine crankshaft position under the control of a first digital computer 80. The pressure values of the selected analog signal are, one by one, converted by the analog-to-digital converter 56 into digital form at one degree of rotation of the engine crankshaft and read into a first memory 57 under the control of the first digital computer 80. The A to D conversion may be performed at a predetermined number of degrees of rotation of the engine crankshaft. The first memory stores signals with values indicative of the sampled pressure in relation to the number of degrees of rotation of the engine crankshaft at which the corresponding pressure values are sampled. The first digital computer 80 is also associated with a second memory 58 which has four limit counters each including a lower limit and upper limit counter.

Figure 28:
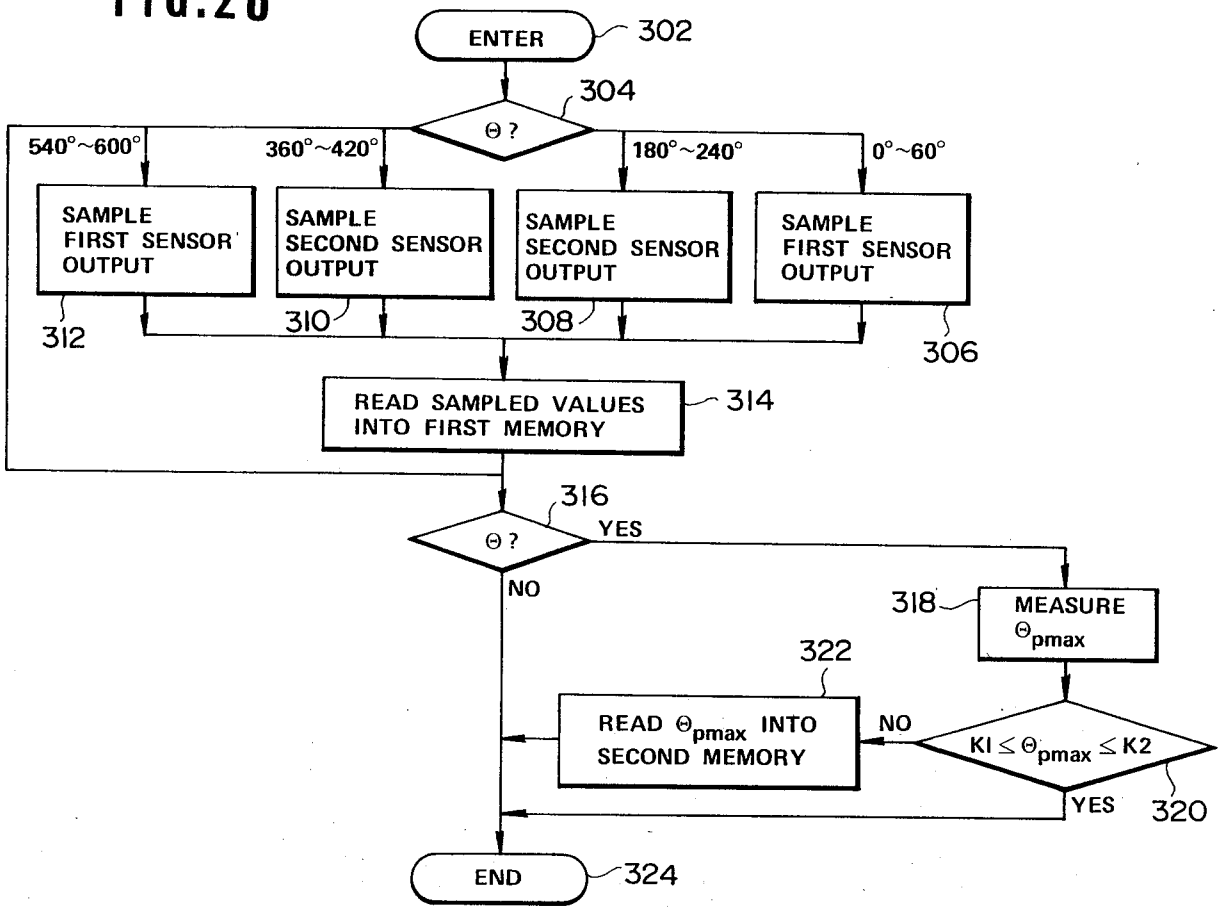
FIG. 28 is a flow diagram of the programming of the first digital computer in FIG. 25.

FIG. 28 is a flow diagram of the programming of the first digital computer 80. The computer program is entered at the point 302. At the point 304 in the program, a determination is made as to whether the number of degrees of rotation of the engine crankshaft $\theta$ from the top dead center position of the engine piston of Cylinder No. 1 is in a range of 0° to 60°, 180° to 240°, 360° to 420°, or 540° to 600° for each data sampling cycle of 720° of rotation of the engine crankshaft. If the engine crankshaft position $\theta$ is in the range of 0° to 60°, then the first digital computer 80 causes the analog multiplexer 55 to connect the first pressure sensor 81 to the analog-to-digital converter 56 at the point 306. Following this, the pressure in Cylinder No. 1 is sampled every degree of rotation of the engine crankshaft. Thus, at the point 314 in the program, the pressure indicative signal from the first pressure sensor 81 is converted into digital form and read into the first memory 57.

At the point 316 in the program, a determination is made as to whether or not the engine crankshaft position has reached 61°. If it has, then the program proceeds to the point 318 wherein the first digital computer 80 terminates the sampling of the pressure in Cylinder No. 1 and calculates the engine crankshaft position $\theta_{pmax}$ at which the maximum pressure value is sampled during the data sampling cycle for Cylinder No. 1. At the following step 320, a determination is made as to whether or not the calculated crankshaft position $\theta_{pmax}$ is within the range between the predetermined lower and upper limits K1 and K2. For example, the lower limit K1 may be selected at 10° after the top dead center position of the engine piston of Cylinder No. 1, and the upper limit K2 may be selected at 25° after the top dead center position of the engine piston of Cylinder No. 1. If the calculated engine crankshaft position $\theta_{pmax}$ is smaller than the lower limit K1 or is larger than the upper limit K2, then the program proceeds to the point 322 which is the same as the point 122 of FIG. 19 and will not be described further for that reason.

If the engine crankshaft position $\theta$ is in the range of 180° to 240° at the point 304, then the program proceeds to the point 308 wherein the first digital computer 80 causes the analog multiplexer 55 to connect the second pressure sensor 82 to the analog-to-digital converter 56. Following this, values indicative of the pressure of the gases in Cylinder No. 3 are sampled every degree of rotation of the engine crankshaft. Thus, at the point 314 in the program, the pressure indicative signal from the second pressure sensor 82 is converted into digital form and read into the first memory 57. At the following point 316, a determination is made as to whether or not the engine crankshaft position $\theta$ reaches 241°. If the answer to this question is "yes", then it means that the sampling of the pressure of the gases in Cylinder No. 3 is completed and the program proceeds to the point 318 wherein the first digital computer 80 calculates the engine crankshaft position $\theta_{pmax}$ at which the maximum pressure value is sampled during the data sampling cycle for Cylinder No. 3. At the following step 320, a determination is made as to whether or not the calculated engine crankshaft position $\theta_{pmax}$ is within the range between predetermined low and upper limits K1 and K2. For example, the lower limit K1 may be selected at 10° after the top dead center position of the engine piston of Cylinder No. 3, and the upper limit K2 may be selected at 25° after the top dead center position of the engine piston of Cylinder No. 3. If the calculated engine crankshaft position $\theta_{pmax}$ is smaller than the lower limit K1 or is larger than the upper limit K2, then the program proceeds to the previously described step 322.

If the engine crankshaft position $\theta$ is in the range of 360° to 420° at the point 304, then the program proceeds to the point 310 wherein the first digital computer 80 causes the analog multiplexer 55 to connect the second pressure sensor 82 to the analog-to-digital converter 56. Following this, values indicative of the pressure of the gases in Cylinder No. 4 are sampled every degree of rotation of the engine crankshaft. Thus, at the point 314 in the program, the pressure indicative signal from the second pressure sensor 82 is converted into digital form and read into the first memory 57. At the following point 316, a determination is made as to whether or not the engine crankshaft position $\theta$ reaches 421°. If the answer to this question is "yes", then it means that the sampling of the pressure of the gases in Cylinder No. 4 is completed and the program proceeds to the point 318 wherein the first digital computer 80 calculates the engine crankshaft position $\theta_{pmax}$ at which the maximum pressure value is sampled during the data sampling cycle for Cylinder No. 4. At the following step 320, a determination is made as to whether or not the calculated engine crankshaft position $\theta_{pmax}$ is within the range between predetermined lower and upper limits K1 and K2. For example, the lower limit K1 may be selected at 10° after the top dead center position of the engine piston of Cylinder No. 4, and the upper limit K2 may be selected at 25° after the top dead center position of the engine piston of Cylinder No. 4. If the calculated engine crankshaft position $\theta_{pmax}$ is smaller than the lower limit K1 or is larger than the upper limit K2, then the program proceeds to the step 322.

If the engine crankshaft position $\theta$ is in the range of 540° to 600° at the point 304, then the program proceeds to the point 312 wherein the first digital computer 80 causes the analog multiplexer 55 to connect the first pressure sensor 81 to the analog-to-digital converter 56. Following this, values indicative of the pressure of the gases in Cylinder No. 2 are sampled every degree of rotation of the engine crankshaft. Thus, at the point 314 in the program, the pressure indicative signal from the first pressure sensor 81 is converted into digital form and read into the first memory 57. At the following point 316, a determination is made as to whether or not the engine crankshaft position $\theta$ reaches 601°. If the answer to this question is "yes", then it means that the sampling of the pressure of the gases in Cylinder No. 2 is completed and the program proceeds to the point 318 wherein the first digital computer 80 calculates the engine crankshaft position $\theta_{pmax}$ at which the maximum pressure value is sampled during the data sampling cycle for Cylinder No. 2. At the following step 320, a determination is made as to whether or not the calculated engine crankshaft position $\theta_{pmax}$ is within the range between predetermined lower and upper limits K1 and K2. For example, the lower limit K1 may be selected at 10° after the top dead center position of the engine piston of Cylinder No. 2, and the upper limit K2 may be selected at 25° after the top dead center position of the engine piston of Cylinder No. 2. If the calculated engine crankshaft position $\theta_{pmax}$ is smaller than the lower limit K1 or is larger than the upper limti K2, then the program proceeds to the previously described step 322.

While the air-fuel ratio control system of the present invention has been described as employing two digital computers, it is to be specifically understood that they may be replaced by a single digital computer without departing from the spirit of the invention. In addition, while the present invention has been described in conjunction with specific embodiments thereof, it is evident that many alternatives, modifications and variations will be apparent to those skilled in the art. Accordingly, it is intended to embrace all alternatives, modifications and variations that fall within the broad scope of the appended claims.

What is claimed is:

1. A method of controlling the air-fuel ratio of a mixture to an internal combustion engine, comprising the steps of:

detecting an engine load condition;

determining, in response to the detected engine load condition, a value of fuel-delivery requirement for the engine;

detecting variations of pressure in at least one cylinder;

detecting an engine crankshaft position $\theta_{pmax}$ at which the pressure in the cylinder is at maximum during each pressure detecting cycle, said detecting cycle starting at the top dead center position of an engine piston of the cylinder and terminating at a predetermined number of degrees of rotation of an engine crankshaft from the top dead center position;

comparing the detected engine crankshaft position $\theta_{pmax}$ with a lower and upper limit;

detecting the number N1 of times the detected engine crankshaft position $\theta_{pmax}$ is greater than the upper limit and the number N2 of times the detected engine crankshaft position $\theta_{pmax}$ is smaller than the lower limit during each predetermined number of rotations of the engine crankshaft; and modifying the determined fuel-delivery requirement value based upon the detected numbers N1 and N2.

2. The method of claim 1, wherein the step of modifying the determined fuel-delivery requirement value based upon the detected numbers N1 and N2 includes:

detecting one of four engine operating conditions of late combustion, early combustion, unstable engine operation, and stable engine operation based upon the detected numbers N1 and N2; and modifying the determined fuel-delivery requirement value to enrich the air-fuel ratio immediately in response to the detected late combustion or the detected unstable engine operation, to lean out the air-fuel ratio immediately in response to the detected early combustion, and to lean out, at the end of the predetermined number of rotations of the engine crankshaft, the air-fuel ratio in response to the detected stable engine operation.

3. The method of claim 2, wherein late combustion is detected upon the occurrence of two conditions when the number N1 exceeds a predetermined value and when the number N2 is zero, wherein early combustion is detected upon the occurrence of two conditions when the number N2 exceeds a predetermined value and when the number N1 is zero, wherein unstable engine operation is detected when the number N1 exceeds the predetermined value and the number N2 is not zero or when the number N2 exceeds the predetermined value and the number N1 is not zero, and wherein stable engine operation is detected upon the occurrence of one of other conditions of the numbers N1 and N2.

4. The method of claim 2, wherein the step of modifying the determined fuel-delivery requirement value includes:

determining a correction factor as $1+K_{R1}$ in response to the detected late combustion, as $1+K_{R2}$ in response to the detected unstable engine operation, as $1-K_{L1}$ in response to the detected early combustion, and as $1-K_{L2}$ in response to the detected stable engine operation; and multiplying the determined fuel-delivery requirement value by the determined correction factor.

5. The method of claim 1, wherein the lower limit is set at 10° after the top dead center position of the engine piston of the cylinder and the upper limit is set at 25° after the top dead center position of the engine piston.

6. The method of claim 1, wherein the step of detecting variations of pressure in at least one cylinder is performed by a single pressure sensor for sensing the pressure in one of the cylinders.

7. The method of claim 1, wherein the step of detecting variations of pressure in at least one cylinder is performed by pressure sensors each sensing the pressure in the respective cylinder.

8. The method of claim 1, wherein the step of detecting variations of pressure in at least one cylinder is performed by at least one pressure sensor for sensing the pressure in adjacent two cylinders.

9. A method of controlling the air-fuel ratio of a mixture to a multi-cylinder internal combustion engine, comprising the steps of:

detecting an engine load condition;

determining, in response to the detected engine load condition, a value of fuel-delivery requirement for the engine;

detecting variations of pressure in each cylinder;

sampling values of pressure in each cylinder in connection with the engine crankshaft position at which the corresponding pressure value is sampled during each data sampling cycle, said data sampling cycle starting at the top dead center position of an engine piston of each cylinder and terminating at a predetermined number of degrees of rotation of the engine crankshaft with respect to the top dead center position;

detecting an engine crankshaft position $\theta_{pmax}$ at which the pressure in each cylinder is at maximum during the data sampling cycle for each cylinder;

comparing the detected engine crankshaft position $\theta_{pmax}$ for each cylinder with a lower and upper limit;

detecting the number N1 of times the detected engine crankshaft position $\theta_{pmax}$ for each cylinder is greater than the upper limit and the number N2 of times the detected engine crankshaft position $\theta_{pmax}$ for each cylinder is smaller than the lower limit during each cycle of a predetermined number of rotations of the engine crankshaft; and modifying the determined fuel-delivery requirement value based upon the detected numbers N1 to N2.

10. The method of claim 9, wherein the step of modifying the determined fuel-delivery requirement value based upon the detected numbers N1 and N2 includes:

detecting one of four engine operating conditions of late combustion, early combustion, unstable engine operation, and stable engine operation based upon the detected numbers N1 and N2; and modifying the determined fuel-delivery requirement value to enrich the air-fuel ratio immediately in response to the detected late combustion or the detected unstable engine operation, to lean out the air-fuel ratio immediately in response to the detected early combustion, and to lean out, at the end of each cycle of the predetermined number of rotations of the engine crankshaft, the air-fuel ratio in response to the detected stable engine operation.

11. The method of claim 10, wherein the step of modifying the determined fuel-delivery requirement value includes:

determining a correction factor as $1+K_{R1}$ in response to the detected late combustion, as $1+K_{R2}$ in response to the detected unstable engine operation, as $1-K_{L1}$ in response to the detected early combustion, and as $1-K_{L2}$ in response to the detected stable engine operation; and multiplying the determined fuel-delivery requirement value by the determined correction factor.

12. The method of claim 9, wherein the lower limit is set at 10° after the top dead center position of the engine piston of each the cylinder and the upper limit is set at 25° after the top dead center position of the engine piston.

13. The method of claim 9, wherein the step of detecting variations of pressure in each cylinder is performed by pressure sensors each sensing the pressure in the respective cylinders.

14. The method of claim 9, wherein the step of detecting variations of pressure in each cylinder is performed by at least one pressure sensor for sensing the pressur in adjacent two cylinders.

15. An air-fuel ratio control system for use in a multi-cylinder internal combustion engine, comprising:

(a) a load sensor for detecting an engine load condition;

(b) a single pressure sensor for detecting variations of pressure in a selected one of the cylinders of the engine; and (c) a digital computer connected to the load sensor and the pressure sensor, the digital computer including (i) means for calculating a value of fuel-delivery requirement for the engine as a function of detected engine load, (ii) means for detecting an engine crankshaft position $\theta_{pmax}$ at which the pressure in the selected cylinder is at a maximum during each pressure detecting cycle of a predetermined number of degrees of rotation of an engine crankshaft, the pressure detecting cycle initiating at the top dead center position of the engine piston of the selected cylinder and terminating at the predetermined number of degrees of rotation of the engine crankshaft from the top dead center position, (iii) means for comparing the detected engine crankshaft position $\theta_{pmax}$ with a lower and upper limit, (iv) means for advancing an upper limit counter when the detected engine crankshaft position $\theta_{pmax}$ is greater than the upper limit and advancing a lower limit counter when the detected engine crankshaft position $\theta_{pmax}$ is smaller than the lower limit during each predetermined number of rotations of the engine crankshaft, and (v) means for modifying the determined fuel-delivery requirement value based upon the counts of the lower and upper limit counters.

16. An air-fuel ratio control system for use in a multi-cylinder internal combustion engine, comprising:

(a) a load sensor for detecting an engine load condition;

(b) a plurality of pressure sensors each detecting variations of pressure in a respective cylinder of the engine; and (c) a digital computer connected to the load sensor and the pressure sensors, the digital computer including (i) means for calculating a value of fuel-delivery requirement for the engine as a function of detected engine load, (ii) means for detecting an engine crankshaft position $\theta_{pmax}$ at which the pressure in each of the cylinders is at maximum during each pressure detecting cycle of a predetermined number of degrees of rotation of an engine crankshaft, (iii) means for comparing the detected engine crankshaft position $\theta_{pmax}$ for each of the cylinders with a lower and upper limit, (iv) means for advancing an upper limit counter when the detected engine crankshaft position $\theta_{pmax}$ for each of the cylinders is greater than the upper limit and advancing a lower limit counter when the detected engine crankshaft position $\theta_{pmax}$ for each of the cylinders is smaller than the lower limit during each cycle of a predetermined number of rotations of the engine crankshaft, and (v) means for modifying the determined fuel-delivery requirement value based upon the counts of the lower and upper limit counters.

17. The system of claim 15, wherein the digital computer includes means for detecting one of four engine operating conditions of late combustion, early combustion, unstable engine operation, and stable engine operation based upon the counts of the lower and upper limit counters, the digital computer including means for enriching the air-fuel ratio immediately in response to the detected late combustion or the detected unstable engine operation, leaning out the air-fuel ratio immediatey in response to the detected early combustion, and leaning out, at the end of each cycle of the predetermined number of rotation of the engine crankshaft, the air-fuel ratio in response to the detected stable engine operation.

18. The system of claim 16, wherein the digital computer includes means for detecting one of four engine operating conditions of late combustion, early combustion, unstable engine operation, and stable engine operation based upon the counts of the lower and upper limit counters, the digital computer including means for enriching the air-fuel ratio immediately in response to the detected late combustion or the detected unstable engine operation, leaning out the air-fuel ratio immediately in response to the detected early combustion, and leaning out, at the end of each cycle of the predetermined number of rotation of the engine crankshaft, the air-fuel ratio in response to the detected stable engine operation.

19. An air-fuel ratio control system for use in a multi-cylinder internal combustion engine, comprising:

(a) a load sensor for detecting an engine load condition;

(b) at least one pressure sensor located between two adjacent cylinders for detecting variations of pressure in the two cylinders; and (c) a digital computer connected to the load sensor and the pressure sensor, the digital computer including (i) means for calculating a value of fuel-delivery requirement for the engine as a function of detected engine load, (ii) means for detecting an engine crankshaft position $\theta_{pmax}$ at which the pressure in each of the cylinders is at maximum during each cycle of a predetermined number of degrees of rotation of an engine crankshaft, (iii) means for comparing the detected engine crankshaft position $\theta_{pmax}$ for each of the cylinders with a lower and upper limit, (iv) means for advancing an upper limit counter when the detected engine crankshaft position $\theta_{pmax}$ for each of the cylinders is greater than the upper limit and advancing a lower limit counter when the detected engine crankshaft position $\theta_{pmax}$ for each of the cylinders is smaller than the lower limit during each cycle of a predetermined number of rotations of the engine crankshaft, and (v) means for modifying the determined fuel-delivery requirement value based upon the counts of the lower and upper limit counters.

20. The system of claim 19, wherein the digital computer includes means for detecting one of four engine operating conditions of late combustion, early combustion, unstable engine operation, and stable engine operation based upon the counts of the lower and upper limit counters, the digital computer including means for enriching the air-fuel ratio immediately in response to the detected late combustion or the detected unstable engine operation, leading out the air-fuel ratio immediately in response to the detected early combustion, and leaning out, at the end of each cycle of the predetermined number of rotations of the engine crankshaft, the air-fuel ratio in response to the detected stable engine operation.

21. A method of controlling the air-fuel ratio of a mixture to an internal combustion engine, comprising the steps of:

detecting an engine load condition;

determining, in response to the detected engine load condition, a value of fuel-delivery requirement for the engine;

detecting variations of pressure in at least one cylinder;

detecting an engine crankshaft position $\theta_{pmax}$ at which the pressure in the cylinder is at maximum during each pressure detecting cycle;

comparing the detected engine crankshaft position $\theta_{pmax}$ with a lower and upper limit;

detecting the number N1 of times the detected engine crankshaft position $\theta_{pmax}$ is greater than the upper limit and the number N2 of times the detected engine crankshaft position $\theta_{pmax}$ is smaller than the lower limit during each cycle of a predetermined number of rotations of the engine crankshaft; and modifying the determined fuel-delivery requirement value based upon the detected numbers N1 and N2.

22. The method of claim 21, wherein the step of modifying the determined fuel-delivery requirement value based upon the detected numbers N1 and N2 includes:

detecting one of four engine operating conditions of late combustion, early combustion, unstable engine operation, and stable engine operation based upon the detected numbers N1 and N2; and modifying the determined fuel-delivery requirement value to enrich the air-fuel ratio immediately in response to the detected late combustion or the detected unstable engine operation, to lean the air-fuel ratio immediately in response to the detected early combustion, and to lean, at the end of the predetermined number for rotation of the engine crankshaft, the air-fuel ratio in response to the detected stable engine operation.

23. The method of claim 22, wherein late combustion is detected upon the occurrence of two conditions when the number N1 exceeds a predetermined value and when the number N2 is zero, wherein early combustion is detected upon the occurrence of two conditions when the number N2 exceeds a predetermined value and when the number N1 is zero, wherein unstable engine operation is detected when the number N1 exceeds the predetermined value and the number N2 is not zero or when the number N2 exceeds the predetermined value and the number N1 is not zero, and wherein stable engine operation is detected upon the occurrence of one of other conditions of the numbers N1 and N2.

24. The method of claim 23, wherein the step of modifying the predetermined fuel-delivery requirement value includes:

determining a correction factor as $1+K_{R1}$ in response to the detected late combustion, as $1+K_{R2}$ in response to the detected unstable engine operation, as $1-K_{L1}$ in response to the detected early combustion, and as $1-K_{L2}$ in response to the detected stable engine operation; and multiplying the determined fuel-delivery requirement value by the determined correction factor.

25. A method of controlling the air-fuel ratio of a mixture to a multicylinder internal combustion engine, comprising the steps of:

detecting an engine load condition;

determining, in response to the detected engine load condition, a value of fuel-delivery requirement for the engine;

detecting variations of pressure in each cylinder;

sampling values of pressure in each of the cylinder in connection with the engine crankshaft position at which the corresponding pressure value is sampled during each data sampling cycle;

detecting an engine crankshaft position $\theta_{pmax}$ at which the pressure in each cylinder is at maximum during the data sampling cycle for each cylinder;

comparing the detected engine crankshaft position $\theta_{pmax}$ for each the cylinder with a lower and upper limit;

detecting the number N1 of times the detected engine crankshaft position $\theta_{pmax}$ for each the cylinder is greater than the upper limit and the number N2 of times the detected engine crankshaft position $\theta_{pmax}$ for each cylinder is smaller than the lower limit during each cycle of a predetermined number of rotations of the engine crankshaft; and modifying the determined fuel-delivery requirement value based upon the detected numbers N1 and N2.

26. The method of claim 25, wherein the step of modifying the determined fuel-delivery requirement value based upon the detected numbers N1 and N2 includes:

detecting one of four engine operating conditions of late combustion, early combustion, unstable engine operation, and stable engine operation based upon the detected number N1 and N2; and modifying the determined fuel-delivery requirement value to enrich the air-fuel ratio immediately in response to the detected late combustion or the detected unstable engine operation, to lean the air-fuel ratio immediately in response to the detected early combustion, and to lean, at the end of each cycle of the predetermined number of rotation of the engine crankshaft, the air-fuel ratio in response to the detected stable engine operation.

27. The method of claim 26, wherein the step of modifying the determined fuel-delivery requirement value includes:

determining a correction factor as $1+K_{R1}$ in response to the detected late combustion, as $1+K_{R2}$ in response to the detected unstable engine operation, as $1-K_{L1}$ in response to the detected early combustion, and as $1-K_{L2}$ in response to the detected stable engine operation; and multiplying the determined fuel-delivery requirement value by the determined correction factor.

* * * * *